US011158247B2

(12) United States Patent
Chen

(10) Patent No.: US 11,158,247 B2
(45) Date of Patent: Oct. 26, 2021

(54) GAMMA ADJUSTMENT METHOD AND ADJUSTMENT DEVICE FOR DISPLAY PANEL

(71) Applicant: KunShan Go-Visionox Opto-Electronics Co., Ltd., Jiangsu (CN)

(72) Inventor: Feng Chen, Kunshan (CN)

(73) Assignee: KunShan Go-Visionox Opto-Electronics Co., Ltd., Kunshan (CN)

( * ) Notice: Subject to any disclaimer, the term of this patent is extended or adjusted under 35 U.S.C. 154(b) by 0 days.

(21) Appl. No.: 17/158,346

(22) Filed: Jan. 26, 2021

(65) Prior Publication Data

US 2021/0150968 A1 May 20, 2021

Related U.S. Application Data

(63) Continuation of application No. PCT/CN2019/097269, filed on Jul. 23, 2019.

(30) Foreign Application Priority Data

Jan. 31, 2019 (CN) ..... 201910100114.6

(51) Int. Cl.
*G09G 3/3208* (2016.01)
*G09G 3/20* (2006.01)
*G09G 3/34* (2006.01)

(52) U.S. Cl.
CPC ..... *G09G 3/3208* (2013.01); *G09G 3/2007* (2013.01); *G09G 3/3406* (2013.01);
(Continued)

(58) Field of Classification Search
CPC .. G09G 3/3208; G09G 3/2007; G09G 3/3406; G09G 2320/0693;
(Continued)

(56) References Cited

U.S. PATENT DOCUMENTS 7,903,128 B2 * 3/2011 Ko ..... G09G 5/06 345/690
9,536,485 B2 * 1/2017 Chen ..... G09G 3/3696
(Continued)

FOREIGN PATENT DOCUMENTS

CN 101419783 A 4/2009
CN 103310752 A 9/2013
(Continued)

OTHER PUBLICATIONS

State Intellectual Property Office of the People's Republic of China, Office Action and Search Report Issued in Application No. 2019101001146, dated May 8, 2020, 14 pages, (Submitted with Machine Translation).
(Continued)

*Primary Examiner* — Michael J Jansen, II
(74) *Attorney, Agent, or Firm* — Maier & Maier, PLLC

(57) ABSTRACT

A gamma adjustment method and an adjustment device for a display panel. The gamma adjustment method describes that if the absolute value of the gamma voltage corresponding to the current grayscale binding point is smaller than the absolute value of the gamma voltage corresponding to the previous grayscale binding point, obtaining absolute values of gamma voltages corresponding to at least two grayscale binding points located previous to the current grayscale binding point. Obtaining a first relationship curve by fitting the respective grayscales corresponding to the at least two grayscale binding points and the absolute values of the gamma voltages corresponding to the at least two grayscale binding points, and adjusting the gamma voltage corresponding to the current grayscale binding point to locate the absolute value of the adjusted gamma voltage corresponding to the current grayscale binding point on the first relationship curve.

20 Claims, 16 Drawing Sheets

(52) U.S. Cl.
CPC ..... *G09G 2310/027* (2013.01); *G09G 2320/0233* (2013.01); *G09G 2320/0276* (2013.01); *G09G 2320/0673* (2013.01); *G09G 2320/0693* (2013.01)

(58) Field of Classification Search
CPC ..... G09G 2320/0276; G09G 2310/027; G09G 2320/0233; G09G 2320/0673; G09G 3/20
See application file for complete search history.

(56) References Cited

U.S. PATENT DOCUMENTS

| | | | | |
|---|---|---|---|---|
| 9,640,128 | B2 * | 5/2017 | Xu | G09G 3/3688 |
| 9,799,299 | B2 * | 10/2017 | Lai | G09G 3/3413 |
| 9,837,045 | B2 * | 12/2017 | Furihata | G09G 3/36 |
| 10,083,663 | B2 * | 9/2018 | Guo | G09G 3/3607 |
| 10,249,245 | B1 * | 4/2019 | Hwang | G09G 3/3233 |
| 10,453,399 | B2 * | 10/2019 | Yu | G09G 3/2092 |
| 10,460,655 | B2 * | 10/2019 | Zhang | H04N 9/69 |
| 10,930,190 | B2 * | 2/2021 | Wang | G09G 3/20 |
| 2007/0223042 | A1 | 9/2007 | Ming-Chia et al. | |
| 2008/0007575 | A1 | 1/2008 | Ming-Chun et al. | |
| 2015/0379953 | A1 * | 12/2015 | Lai | G09G 3/3413 345/88 |
| 2016/0035293 | A1 | 2/2016 | Hirobumi et al. | |
| 2016/0049118 | A1 * | 2/2016 | Chen | G09G 3/3696 345/205 |
| 2016/0196793 | A1 | 7/2016 | Xiangyang | |
| 2018/0197492 | A1 * | 7/2018 | Guo | G09G 3/3696 |
| 2019/0043429 | A1 * | 2/2019 | Yu | G09G 3/2092 |
| 2019/0051235 | A1 * | 2/2019 | Zhang | H04N 1/60 |
| 2020/0051478 | A1 * | 2/2020 | Wang | G09G 3/20 |
| 2020/0286423 | A1 * | 9/2020 | Yu | G09G 3/3208 |
| 2021/0150968 | A1 * | 5/2021 | Chen | G09G 3/2007 |
| 2021/0150987 | A1 * | 5/2021 | Jiang | G09G 3/20 |

FOREIGN PATENT DOCUMENTS

| | | | |
|---|---|---|---|
| CN | 103761945 | A | 4/2014 |
| CN | 105702215 | A | 6/2016 |
| CN | 105741775 | A | 7/2016 |
| CN | 106128383 | A | 11/2016 |
| CN | 106531065 | A | 3/2017 |
| CN | 107665689 | A | 2/2018 |
| CN | 108364606 | A | 8/2018 |
| CN | 108550345 | A | 9/2018 |
| CN | 109029918 | A | 12/2018 |
| CN | 109166555 | A | 1/2019 |

OTHER PUBLICATIONS

State Intellectual Property Office of the People's Republic of China, Office Action and Search Report Issued in Application No. 2019101001146, dated Jul. 29, 2020, 10 pages, (Submitted with Machine Translation).

ISA State Intellectual Property Office of the People's Republic of China, International Search Report Issued in Application No. PCT/CN2019/097269, dated Nov. 1, 2019, WIPO, 4 pages.

ISA State Intellectual Property Office of the People's Republic of China, Written Opinion of the International Searching Authority Issued in Application No. PCT/CN2019/097269, dated Nov. 1, 2019, WIPO, 6 pages.

* cited by examiner

GAMMA ADJUSTMENT METHOD AND ADJUSTMENT DEVICE FOR DISPLAY PANEL

CROSS-REFERENCE TO RELATED APPLICATION

This application is a continuation application of International Application No. PCT/CN2019/097269 filed on Jul. 23, 2019, which claims priority to Chinese patent application No. 2019101001146 filed on Jan. 31, 2019. Both applications are incorporated herein by reference in their entireties.

FIELD

This application relates to the field of display technology, and in particular to a gamma adjustment method and an adjustment device for a display panel.

BACKGROUND

Luminance perceived by human eyes and actual display luminance of a display panel have a non-linear relationship. In a low-luminance environment, human eyes are more sensitive to luminance variations, and the opposite is true in a high-luminance environment. This characteristic of the human eyes is called Gamma characteristic. Due to the characteristics of the non-linear perception of luminance by human eyes, if we are to have a perception that luminance is uniformly varying, the luminance of the display panel is to vary non-uniformly to adapt to the Gamma characteristics of human eyes. A non-linear parameter of luminance and grayscale of the display panel can be called Gamma parameter, and the curve drawn according to Gamma parameters is called Gamma characteristic curve. The Gamma parameter describes the non-linear relationship between luminance and grayscale, that is, the non-linear relationship between luminance and data line input voltage. Therefore, if the luminance of the display panel and the data line input voltage do not conform to the above-mentioned Gamma characteristic curve, Gamma correction is to be performed on the display panel.

SUMMARY

The application provides a gamma adjustment method and a gamma adjustment device for a display panel and a display device.

According to a first aspect of the embodiments of the present disclosure, a gamma adjustment method for a display panel is provided. The method including: determining whether a current display panel is a first display panel in a current display panel group; in response to determining that the current display panel is the first display panel in the current display panel group, for a first current grayscale binding point in a non-low grayscale binding point interval, adjusting an data line input voltage of pixels of the current display panel to a first reference gamma voltage; and in response to determining that the current display panel is not the first display panel in the current display panel group, adjusting the data line input voltage of the pixels to a gamma voltage corresponding to a reference grayscale binding point of any one of the display panels that have been gamma adjusted, wherein a grayscale of the reference grayscale binding point is the same as a grayscale of the first current grayscale binding point; adjusting the data line input voltage of the pixels according to a comparison result between a sampled value and a first target value of an optical parameter of the pixels, and taking the data line input voltage of the pixels when the sampled value of the optical parameter is substantially equal to the first target value as a gamma voltage corresponding to the first current grayscale binding point; for a second current grayscale binding point in a low grayscale binding point interval, determining whether an absolute value of a gamma voltage corresponding to the second current grayscale binding point is smaller than an absolute value of a gamma voltage corresponding to a previous grayscale binding point; in response to determining that the absolute value of the gamma voltage corresponding to the second current grayscale binding point is smaller than the absolute value of the gamma voltage corresponding to the previous grayscale binding point, obtaining absolute values of gamma voltages corresponding to at least two grayscale binding points located previous to the second current grayscale binding point; wherein the grayscale corresponding to the previous grayscale binding point and the respective grayscales corresponding to the at least two grayscale binding points are larger than the grayscale of the second current grayscale binding point; obtaining a first relationship curve between grayscales and absolute values of gamma voltages by fitting the respective grayscales corresponding to the at least two grayscale binding points and the absolute values of the gamma voltages corresponding to the at least two grayscale binding points; and adjusting the gamma voltage corresponding to the second current grayscale binding point according to the grayscale corresponding to the second current grayscale binding point and the first relationship curve, in a way that the absolute value of the adjusted gamma voltage corresponding to the second current grayscale binding point is located on the first relationship curve.

According to a second aspect of the embodiments of the present disclosure, a gamma adjustment device for a display panel is provided. The device including: a first determining module configured to determine whether a current display panel is a first display panel in a current display panel group; a first adjusting module configured to, for a first current grayscale binding point in a non-low grayscale binding point interval, adjust a data line input voltage of pixels of the current display panel to a first reference gamma voltage when the current display panel is the first display panel in the current display panel group; a second adjusting module configured to adjust the data line input voltage of the pixels to a gamma voltage corresponding to a reference grayscale binding point of any display panel that has been gamma adjusted when the current display panel is not the first display panel in the current display panel group, and the grayscale of the reference grayscale binding point is the same as the grayscale corresponding to the first current grayscale binding point; a third adjusting module configured to adjust the data line input voltage of the pixels according to a comparison result between a sampled value and a first target value of an optical parameter of the pixels, and determine the data line input voltage of the pixels as the gamma voltage when the sampled value of the optical parameter is substantially equal to the first target value; a second determining module configured to, for a second current grayscale binding point in a low grayscale binding point interval, determine whether an absolute value of a gamma voltage corresponding to the second current grayscale binding point is smaller than an absolute value of a gamma voltage corresponding to a previous grayscale binding point; a first obtaining module configured to obtain absolute values of gamma voltages corresponding to at least two grayscale binding points located previous to the second current grayscale binding point when it is determined that the absolute value of the gamma voltage corresponding to the second current grayscale binding point is smaller than the absolute value of the gamma voltage corresponding to the previous grayscale binding point, and the grayscale corresponding to the previous grayscale binding point, the grayscales corresponding to the at least two grayscale binding points are respectively larger than the grayscale corresponding to the second current grayscale binding point; a fitting module configured to obtain a first relationship curve between grayscales and absolute values of gamma voltages by fitting the absolute values of the gamma voltages corresponding to the at least two grayscale binding points; and a fourth adjusting module configured to adjust the gamma voltage of the second current grayscale according to the grayscale corresponding to the second current grayscale binding point and the first relationship curve, to make the absolute value of the adjusted gamma voltage of the second current grayscale binding point be located on the first relationship curve.

According to a third aspect of the embodiments of the present disclosure, a display device including a display panel and the above-mentioned gamma adjustment device is provided.

The beneficial effects of the embodiment include: by determining whether the current display panel is the first display panel in the current display panel group, for the first current grayscale binding point in the non-low grayscale binding point interval, the data line input voltage of the pixels of the current display panel can be adjusted to the first reference gamma voltage when the current display panel is the first display panel in the current display panel group, or the data line input voltage of the pixels can be adjusted to the gamma voltage corresponding to the reference grayscale binding point of any display panel that has been gamma adjusted when the current display panel is not the first display panel in the current display panel group. The grayscale of the reference grayscale binding point is the same as the grayscale corresponding to the first current grayscale binding point. In this way, the data line input voltage of the first current grayscale binding point of the current display panel can quickly approach the gamma voltage corresponding to the first current grayscale binding point, which may shorten the time of gamma adjustment and improve the efficiency of gamma adjustment.

Furthermore, since the data line input voltage of the pixels is adjusted according to the comparison result between the sampled value and the first target value of the optical parameter of the pixels, the gamma adjustment may be more targeted, which may beneficial to shorten the duration of gamma adjustment and improve the efficiency of gamma adjustment.

Moreover, for the second current grayscale binding point in the low grayscale binding point interval, when it is determined that the absolute value of the gamma voltage corresponding to the second current grayscale binding point is smaller than the absolute value of the gamma voltage corresponding to the previous grayscale binding point, the absolute values of the gamma voltages corresponding to the at least two grayscale binding points located previous to the second current grayscale binding point can be obtained, and a first relationship curve between the grayscales and the absolute values of the gamma voltages can be obtained by fitting the absolute values of the gamma voltages corresponding to the at least two grayscale binding points, and then the gamma voltage of the second current grayscale binding point is adjusted according to the grayscale corresponding to the second current grayscale binding point and the first relationship curve, to make the absolute value of the gamma voltage of the second current grayscale binding point that has been adjusted be located on the first relationship curve. Since the gamma voltages of all grayscale binding points of the same display panel have the same variation trend along descending or ascending order of the grayscale binding points, the second current grayscale binding point should actually be located on the first relationship curve or close to the first relationship curve. Therefore, the absolute value of the gamma voltage corresponding to the grayscale of the second current grayscale binding point on the first relationship curve should be the absolute value of the actual gamma voltage corresponding to the grayscale of the second current grayscale binding point, or close to the absolute value of the actual gamma voltage corresponding to the grayscale of the second current grayscale binding point. Therefore, the absolute value of the adjusted gamma voltage corresponding to the second current grayscale binding point on the first relationship curve is closer to the absolute value of the actual gamma voltage corresponding to the grayscale corresponding to the second current grayscale binding point. In this way, by determining whether the gamma voltage is reversed and correcting in the case of reversal during the gamma adjustment process, the problem of low grayscale black band, bright band or color shift caused by gamma voltage reversal can be avoided.

According to a fourth aspect of the embodiments of the present disclosure, a gamma adjustment method for display panel is provided. the display panel includes a non-transparent display area and a transparent display area, the transparent display area is a double-sided light-emitting display area, a front of the transparent display area is a side facing an ambient light and a back of the transparent display area is a side facing away from the ambient light, and the method includes: adjusting a data line input voltage of pixels in the transparent display area to a current gamma voltage corresponding to a current grayscale binding point; obtaining a current back-side light-emitting luminance of the transparent display area; obtaining a target back-side light-emitting luminance according to a grayscale corresponding to the current grayscale binding point and a pre-stored first correspondence between back-side light-emitting luminance of the transparent display area and grayscales; wherein for the current grayscale binding point, when the back-side light-emitting luminance of the transparent display area is the target back-side light-emitting luminance, a front-side light-emitting luminance of the transparent display area is substantially the same as a light-emitting luminance of the non-transparent display area; determining a third target adjustment step according to a comparison result between the current back-side light-emitting luminance and the target back-side light-emitting luminance; adjusting the data line input voltage of the pixels according to the third target adjustment step, and taking the data line input voltage when the back-side light-emitting luminance of the transparent display area is substantially the same as the target back-side light-emitting luminance as the target gamma voltage.

According to a fifth aspect of the embodiments of the present disclosure, a gamma adjustment device for display panel which adjusts the display panel after leaving the factory is provided. The display panel includes a non-transparent display area and a transparent display area. The transparent display area is a double-sided light-emitting display area, and the front of the transparent display area is the side facing the ambient light and the back of the transparent display area is the side facing away from the ambient light. The gamma adjustment device includes: a fifth adjusting module configured to adjust the data line input voltage of the pixels of the display panel to the current gamma voltage of the current grayscale binding point; a second obtaining module configured to obtain the current back-side light-emitting luminance of the transparent display area; a third obtaining module configured to obtain the corresponding target back-side light-emitting luminance according to the grayscale of the current grayscale binding point and the pre-stored first correspondence between back-side light-emitting luminance of the transparent display area and grayscales, where for the current grayscale binding point, when the back-side light-emitting luminance of the transparent display area is the target back-side light-emitting luminance, the front-side light-emitting luminance of the transparent display area is substantially the same as the light-emitting luminance of the non-transparent display area; a third determining module configured to determine a third target adjustment step according to a comparison result between the current back-side light-emitting luminance and the target back-side light-emitting luminance; and a sixth adjusting module configured to adjust the data line input voltage of the pixels according to the third target adjustment step, and the data line input voltage is taken as the target gamma voltage when the back-side light-emitting luminance of the transparent display area is substantially the same as the target back-side light-emitting luminance.

The beneficial effects of the embodiments of the present application may include: after the display panel leaves the factory, the data line input voltage of the pixels of the display panel can be adjusted to the current gamma voltage of the current grayscale binding point, and the current back-side light-emitting luminance of the transparent display area can be obtained. Then, according to the grayscale of the current grayscale binding point and the pre-stored first correspondence between back-side light-emitting luminance of the transparent display area and grayscales, the target back-side light-emitting luminance corresponding to the grayscale can be obtained. For the same grayscale binding point, when the back-side light-emitting luminance of the transparent display area is the target back-side light-emitting luminance, the front-side light-emitting luminance of the transparent display area is substantially the same as the light-emitting luminance of the non-transparent display area. Then, the third target adjustment step can be determined according to a comparison result between the current back-side light-emitting luminance and the target back-side light-emitting luminance, and the data line input voltage of the pixel is adjusted according to the third target adjustment step, and the data line input voltage is taken as the target gamma voltage when the back-side light-emitting luminance of the transparent display area is substantially the same as the target back-side light-emitting luminance Thus, after the gamma voltage of the transparent display area is corrected, the front-side light-emitting luminance of the transparent display area can be substantially the same as the light-emitting luminance of the non-transparent display area. The embodiments of the present application can reduce or eliminate the difference in luminance between the transparent display area and the non-transparent display area under the premise that the photosensitive element below the transparent display area can receive a sufficient amount of light, thereby improving the display effect.

According to a sixth aspect of the embodiments of the present disclosure, a gamma adjustment device for a display panel is provided. The device include: a display; a memory configured to store computer program codes, and the computer program codes comprise computer instructions; and; and one or more processors connected to the display and the memory. The one or more processors are configured to perform the above mentioned gamma adjustment method for the display panel when the one or more processors execute the computer instructions, and gamma adjustment information generated by the one or more processors is displayed on the display.

According to a seventh aspect of the embodiments of the present disclosure, a display device included display panel and the above-mentioned gamma adjustment device for the display panel is provided.

According to an eighth aspect of the embodiments of the present disclosure, a computer storage medium including computer instructions is provided. When the computer instructions are executed on the computer, the computer is caused to perform the gamma adjustment method for the display panel described above.

The above general description and the following detailed description are merely exemplary and explanatory and are not intended to limit the present application.

DETAILED DESCRIPTION

Figure 1:
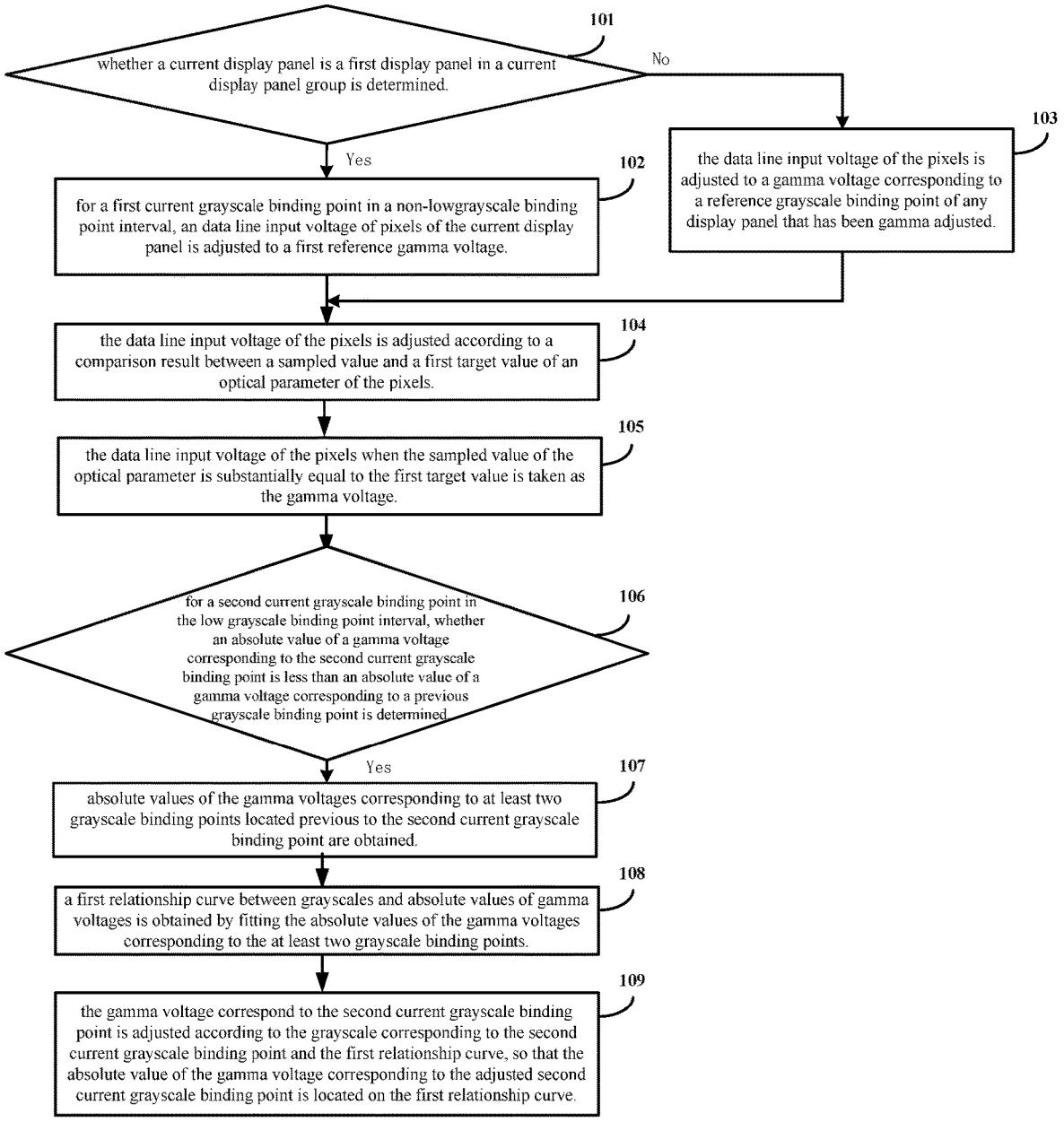
FIG. 1 is a flowchart showing a gamma adjustment method for a display panel according to an embodiment of the present application.

Examples will be described in detail herein, with the illustrations thereof represented in the drawings. When the following descriptions involve the drawings, like numerals in different drawings refer to like or similar elements unless otherwise indicated. The embodiments described in the following examples do not represent all embodiments consistent with the present disclosure. Rather, they are merely examples of apparatuses and methods consistent with some aspects of the present disclosure as detailed in the appended claims.

LCMs (LCD Modules, or LCD display modules) of a same type can use a same set of gamma voltages. A set of gamma voltages includes gamma voltages corresponding to each grayscale in 0-255 grayscales. However, due to process differences, AMOLED (Active-matrix organic light-emitting diode) display panels are quite different from one another, unlike LCMs with high consistency, therefore, gamma adjustment is to be performed on each display panel before leaving the factory to obtain a respective set of gamma voltages for each display panel. A set of gamma voltages of the display panel may include gamma voltages corresponding to each grayscale in 0-255 grayscales.

Therefore, how to improve the efficiency of gamma adjustment is a technical problem to be solved.

The embodiments of the present application provide a gamma adjustment method and an adjustment device for a display panel, and a display device, which can solve the above technical problems, not only can improve the efficiency of gamma adjustment, but also can avoid the problems of low grayscale black band, bright band or color shift caused by gamma voltage reversal.

FIG. 1 is a flowchart showing a gamma adjustment method for a display panel according to an embodiment of the present application. The gamma adjustment method of the display panel, as shown in FIG. 1, may include the following steps 101-109.

At step 101, whether a current display panel is a first display panel in a current display panel group is determined. When the current display panel is the first display panel in the current display panel group, step 102 is performed. When the current display panel is not the first display panel in the current display panel group, step 103 is performed.

When performing gamma adjustment on a display panel, a gamma adjustment device with an adjustment program and an optical measuring instrument are required. The gamma adjustment device can continuously perform gamma adjustment on a plurality of display panels of a same batch during the time period from startup to shutdown. The plurality of display panels can be called a display panel group.

When performing gamma adjustment on the display panels in each display panel group, the gamma adjustment device may perform gamma adjustment on the first display panel and the non-first display panel in each display panel group by different gamma adjustment methods. Specifically, for the current display panel group, the gamma adjustment device may determine whether the current display panel is the first display panel in the current display panel group. When the current display panel is the first display panel in the current display panel group, step 102 is performed. When the current display panel is not the first display panel in the current display panel group, step 103 is performed.

At step 102, for a first current grayscale binding point in a non-low grayscale binding point interval, an data line input voltage of pixels of the current display panel is adjusted to a first reference gamma voltage.

In an embodiment, a plurality of grayscales may be selected from 0 to 255 grayscales as grayscale binding points (corresponding to adjustable grayscales in the driver chip) and gamma adjustment is performed thereto, to obtain respective gamma voltages of each grayscale binding point for data fitting, so as to obtain respective gamma voltages of other grayscales. In an embodiment, the selected plurality of grayscale binding points may be evenly distributed from 0 to 255, so that the result of data fitting is more accurate.

In an embodiment, according to the luminance level, the selected plurality of grayscale binding points may be divided into a low grayscale binding point interval, a medium-grayscale binding point interval, and a high-grayscale binding point interval. Where, the medium-grayscale binding point interval and the high-grayscale binding point interval may be called a non-low grayscale binding point interval. A grayscale of a grayscale binding point in the low grayscale binding point interval is smaller than a grayscale of a grayscale binding point in the non-low grayscale binding point interval. A boundary point between the low grayscale binding point interval and the non-low grayscale binding point interval may be a designated binding point, for example, a grayscale with luminance of 1 nit in a gamma curve with a gamma value of 2.2.

In an embodiment, the gamma adjustment device can perform gamma adjustment on the plurality of grayscale binding points respectively according to a preset adjustment sequence. For example, the gamma adjustment device can perform gamma adjustment on the plurality of grayscale binding points respectively in a descending order of grayscales, or can perform gamma adjustment on the plurality of grayscale binding points respectively in an ascending order of grayscales. In the embodiment of the present application, the gamma adjustment device performs gamma adjustment on the plurality of grayscale binding points respectively in a descending order of grayscales. Specifically, the gamma adjustment device first performs gamma adjustment on the grayscale binding points in the non-low grayscale binding point interval in a descending order of grayscales, and then performs gamma adjustment on the grayscale binding points in the low grayscale binding point interval in a descending order of grayscales.

In an embodiment, a pixel unit of the display panel may include a plurality of pixels of N colors, and N is a positive integer. For example, N may be 3, and the pixel unit may include a red pixel R, a green pixel G, and a blue pixel B. Pixels of each color correspond to a set of gamma voltages. When performing gamma adjustment on the display panel, the pixels of each color can be adjusted separately. In the embodiment of the present application, gamma adjustment for pixels of one color will be described in detail.

In an embodiment, when the current display panel is the first display panel in the current display panel group, for a first current grayscale binding point in the non-low grayscale binding point interval, the gamma adjustment device can adjust the data line input voltage of the pixels of the current display panel to the first reference gamma voltage. The first reference gamma voltage is a reference value of the gamma voltage corresponding to the first current grayscale binding point, and the first reference gamma voltage is located near the gamma voltage corresponding to the first current grayscale binding point. In this way, the data line input voltage of the first current grayscale binding point of the current display panel can quickly approach to the gamma voltage corresponding to the first current grayscale binding point, which may shorten the time of gamma adjustment and improve the efficiency of gamma adjustment.

In an embodiment, the first reference gamma voltage may be a value pre-stored in the gamma adjustment device, or may be a value obtained by the gamma adjustment device through a data test.

At step 103, the data line input voltage of the pixels is adjusted to a gamma voltage corresponding to a reference grayscale binding point of any display panel that has been gamma adjusted. A grayscale of the reference grayscale binding point is the same as a grayscale of the first current grayscale binding point.

In an embodiment, when the current display panel is not the first display panel in the current display panel group, for the first current grayscale binding point in the non-low grayscale binding point interval, the gamma adjustment device may adjust the data line input voltage of the pixels to the gamma voltage corresponding to the reference grayscale binding point of any display panel that has been gamma adjusted. The grayscale of the reference grayscale binding point is the same as the grayscale of the first current grayscale binding point. Since the manufacturing processes of the display panels of a same batch are substantially the same, the gamma voltages of different display panels are substantially the same for the same grayscale binding point. Where, "substantially the same" means that the gamma voltages of different display panels are the same, or an absolute value of the difference between the gamma voltages of different display panels is less than a designated voltage value. Therefore, the gamma adjustment device can pre-store a set of gamma voltages of any display panel that has been gamma adjusted as reference values for gamma voltages of subsequent display panels. In this way, the data line input voltage of the first current grayscale binding point of the current display panel can quickly approach the gamma voltage corresponding to the first current grayscale binding point, which may shorten the time of gamma adjustment and improve the efficiency of gamma adjustment.

At step 104, the data line input voltage of the pixels is adjusted according to a comparison result between a sampled value and a first target value of an optical parameter of the pixels.

At this step, the gamma adjustment device may obtain the sampled value of the optical parameter of the pixels through the optical measuring instrument and pre-store the first target value of the optical parameter of the pixels. The first target value of the optical parameter of the pixels may be obtained by calculation from the first current grayscale binding point and a designated gamma curve. Where, the gamma curve is used to indicate a relationship between each grayscale and the target value of the optical parameter. For example, when the optical parameter is luminance, the designated gamma curve may be a gamma curve with a gamma value of 2.2.

At this step, the gamma adjustment device may compare the sampled value and the first target value of the optical parameter of the pixels, and determine an adjustment direction and an adjustment step according to the comparison result, and then adjust the data line input voltage of the pixels according to the determined adjustment direction and the adjustment step, to make the data line input voltage of the pixel approach the gamma voltage.

At step 105, the data line input voltage of the pixels when the sampled value of the optical parameter is substantially equal to the first target value is taken as the gamma voltage.

At this step, the gamma adjustment device may take the data line input voltage of the pixel as the gamma voltage when the sampled value of the optical parameter is substantially equal to the first target value. That the sampled value of the optical parameter is substantially equal to the first target value includes two situations: one is that the sampled value of the optical parameter is equal to the first target value, the other is the absolute value of the difference between the sampled value of the optical parameter and the first target value is less than the designated optical parameter value.

At steps 104 to 105, since the data line input voltage of the pixels is adjusted according to the comparison result between the sampled value and the first target value of the optical parameter of the pixels, the gamma adjustment may be more targeted, which may be beneficial to shorten the time of gamma adjustment and improve the efficiency of gamma adjustment.

The above is the gamma adjustment method for a grayscale binding point in the non-low grayscale binding point interval, and the following is a gamma adjustment method for a grayscale binding point in the low grayscale binding point interval.

At step 106, for a second current grayscale binding point in the low grayscale binding point interval, whether an absolute value of a gamma voltage corresponding to the second current grayscale binding point is less than an absolute value of a gamma voltage corresponding to a previous grayscale binding point is determined. When the absolute value of the gamma voltage corresponding to the second current grayscale binding point is less than the absolute value of the gamma voltage corresponding to the previous grayscale binding point, step 107 is performed.

In an embodiment, the absolute value of the gamma voltage of the grayscale binding point increases as the grayscale decreases. In an embodiment, depending upon a type of a driving transistor in the pixel driving circuit of the display panel, the data line input voltages are different. For example, when the driving transistor is a P-type transistor, the grayscale decreases when the data line input voltage increases. On the contrary, when the driving transistor is an N-type transistor, the grayscale increases when the data line input voltage increases. The driving transistor may be a TFT (Thin Film Transistor) or an MOS (Metal-Oxide-Semiconductor) transistor (for example, metal-oxide-semiconductor field-effect transistor). The embodiments of the present application are not limited to the embodiments provided above.

When performing gamma adjustment on grayscale binding points in the low grayscale binding point interval, due to the small grayscale and low luminance, the sampled value of the optical parameter obtained by the optical measuring instrument may occasionally be inaccurate, resulting in that the gamma voltage of the grayscale binding point with a smaller grayscale is unexpectedly lower than the gamma voltage of the grayscale binding point with a larger grayscale. To avoid the above situation, for the second current grayscale binding point in the low grayscale binding point interval, the gamma adjustment device may determine whether the absolute value of the gamma voltage corresponding to the second current grayscale binding point is smaller than the absolute value of the gamma voltage corresponding to the previous grayscale binding point. When the absolute value of the gamma voltage corresponding to the second current grayscale binding point is smaller than the absolute value of the gamma voltage corresponding to the previous grayscale binding point, step 107 is performed.

Figure 2:
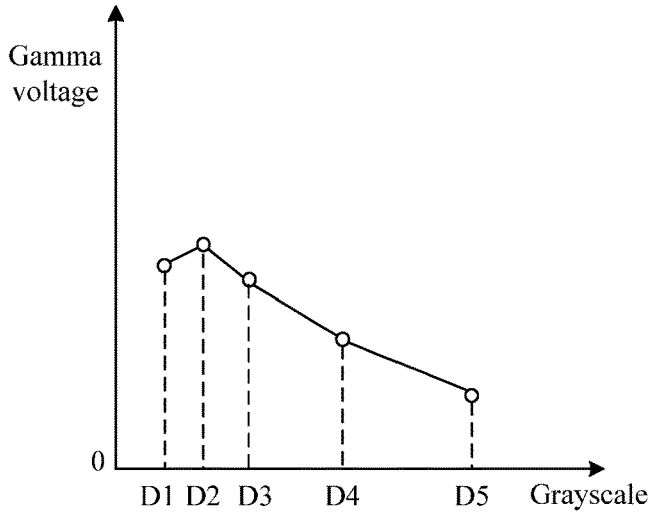
FIG. 2 is a schematic diagram showing a relationship between grayscale and gamma voltage according to an embodiment of the present application.

In an exemplary embodiment, the driving transistor is an N-type transistor, and the data line input voltage is a positive voltage. As shown in FIG. 2, the gamma voltage of the grayscale binding points D5, D4, D3 and D2 in the low grayscale binding point interval increases as the grayscale decreases. However, when the gamma voltage of the grayscale binding point D1 is smaller than the gamma voltage of the grayscale binding point D2, step 107 is performed, where the grayscale of the grayscale binding point D1 is smaller than the grayscale of the grayscale binding point D2, and the grayscale binding point D2 is the previous grayscale binding point of the second current grayscale binding point D1.

At step 107, absolute values of the gamma voltages corresponding to at least two grayscale binding points located previous to the second current grayscale binding point are obtained. The grayscale corresponding to the previous grayscale binding point, the grayscales corresponding to the at least two grayscale binding points are respectively larger than the grayscale corresponding to the second current grayscale binding point.

At this step, from the grayscale binding points that have been gamma adjusted, the gamma adjustment device can obtain the absolute values of the gamma voltages corresponding to at least two grayscale binding points whose grayscales are respectively larger than that of the second current grayscale binding point. The at least two grayscale binding points whose grayscales are respectively larger than that of the second current grayscale binding point may be sequentially adjacent to the second current grayscale binding point. Specifically, for the at least two grayscale binding points, an interval between the grayscale binding point of the smaller grayscale and the second current grayscale binding point is smaller, and an interval between the grayscale binding point of the larger grayscale and the second current grayscale binding point is larger.

In an embodiment, as shown in FIG. 2, the gamma adjustment device can obtain absolute values of the gamma voltages of the grayscale binding points D5, D4, D3 and D2, and can also obtain absolute values of the gamma voltages of the grayscale binding points D3 and D2. When the absolute values of the gamma voltages of the grayscale binding points D3 and D2 are obtained, the grayscale binding points D2 and D3 are sequentially adjacent to the second current grayscale binding point D1. The grayscale of the grayscale binding point D2 is smaller and the grayscale binding point D2 is closer to the second current grayscale binding point D1, while the grayscale of the grayscale binding point D3 is larger and the grayscale binding point D3 is farther from the second current grayscale binding point D1. For example, the grayscale binding point D2 is the previous grayscale binding point of the second current grayscale binding point D1. At step 106, the absolute value of the gamma voltage corresponding to the grayscale binding point D2 has been compared with the absolute value of the gamma voltage corresponding to the second current grayscale binding point D1. Therefore, at this step 107, the absolute value of the gamma voltage corresponding to the grayscale binding point D2 can be repeatedly obtained.

At step 108, a first relationship curve between grayscales and absolute values of gamma voltages is obtained by fitting the absolute values of the gamma voltages corresponding to the at least two grayscale binding points.

At this step, the gamma adjustment device may perform data fitting on the obtained absolute values of the gamma voltages of the at least two grayscale binding points, to obtain the first relationship curve between grayscales and absolute values of gamma voltages. In the first relationship curve, each grayscale corresponds to an absolute value of one gamma voltage.

At step 109, the gamma voltage correspond to the second current grayscale binding point is adjusted according to the grayscale corresponding to the second current grayscale binding point and the first relationship curve, so that the absolute value of the gamma voltage corresponding to the adjusted second current grayscale binding point is located on the first relationship curve.

At this step, the gamma adjustment device may obtain an absolute value of the gamma voltage corresponding to the second current grayscale binding point by calculation from the grayscale of the second current grayscale binding point and the first relationship curve, and determine a corresponding gamma voltage according to the obtained absolute value of the gamma voltage and the type of the driving transistor in the pixel driving circuit of the display panel.

At this step, the gamma adjustment device may adjust the gamma voltage corresponding to the second current grayscale binding point to the above determined gamma voltage, and the absolute value of the adjusted gamma voltage of the second current grayscale binding point is located on the first relationship curve.

Figure 3:
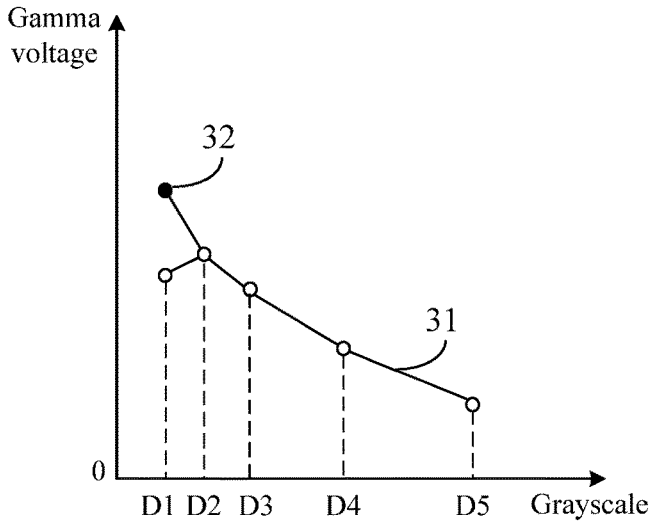
FIG. 3 is a schematic diagram showing another relationship between grayscale and gamma voltage according to an embodiment of the present application.

In an embodiment, as shown in FIG. 3, the gamma adjustment device may obtain the absolute values of the gamma voltages of the grayscale binding points D5, D4, D3 and D2, and perform data fitting on the absolute values of the gamma voltages of the grayscale binding points D5, D4, D3 and D2, to obtain the first relationship curve 31. Then, the gamma adjustment device may obtain the absolute value of the gamma voltage corresponding to the second current grayscale binding point D1 on the first relationship curve 31 according to the grayscale of the grayscale binding point D1 and the first relationship curve 31. As shown in FIG. 3, the obtained absolute value of the gamma voltage corresponding to the second current grayscale binding point D1 on the first relationship curve 31 may be the absolute value of the gamma voltage corresponding to the data point 32.

At this step, according to the absolute value of the adjusted gamma voltage corresponding to the second current grayscale binding point, the gamma adjustment device may determine and save the gamma voltage corresponding to the second current grayscale binding point. For example, as shown in FIG. 3, the absolute value of the gamma voltage corresponding to the second current grayscale binding point D1 is smaller than the absolute value of the gamma voltage corresponding to the data point 32, and the gamma adjusting device adjusts the absolute value of the gamma voltage corresponding to the second current grayscale binding point D1 to the absolute value of the gamma voltage corresponding to the data point 32, to make the absolute value of the gamma voltage corresponding to the second current grayscale binding point D1 be located on the first relationship curve 31.

The beneficial effects of the embodiment include: by determining whether the current display panel is the first display panel in the current display panel group, for the first current grayscale binding point in the non-low grayscale binding point interval, the data line input voltage of the pixels of the current display panel can be adjusted to the first reference gamma voltage when the current display panel is the first display panel in the current display panel group, or the data line input voltage of the pixels can be adjusted to the gamma voltage corresponding to the reference grayscale binding point of any display panel that has been gamma adjusted when the current display panel is not the first display panel in the current display panel group. The grayscale of the reference grayscale binding point is the same as the grayscale corresponding to the first current grayscale binding point. In this way, the data line input voltage of the first current grayscale binding point of the current display panel can quickly approach the gamma voltage corresponding to the first current grayscale binding point, which may shorten the time of gamma adjustment and improve the efficiency of gamma adjustment.

Furthermore, since the data line input voltage of the pixels is adjusted according to the comparison result between the sampled value and the first target value of the optical parameter of the pixels, the gamma adjustment may be more targeted, which may beneficial to shorten the duration of gamma adjustment and improve the efficiency of gamma adjustment.

Moreover, for the second current grayscale binding point in the low grayscale binding point interval, when it is determined that the absolute value of the gamma voltage corresponding to the second current grayscale binding point is smaller than the absolute value of the gamma voltage corresponding to the previous grayscale binding point, the absolute values of the gamma voltages corresponding to the at least two grayscale binding points located previous to the second current grayscale binding point can be obtained, and a first relationship curve between the grayscales and the absolute values of the gamma voltages can be obtained by fitting the absolute values of the gamma voltages corresponding to the at least two grayscale binding points, and then the gamma voltage of the second current grayscale binding point is adjusted according to the grayscale corresponding to the second current grayscale binding point and the first relationship curve, to make the absolute value of the gamma voltage of the second current grayscale binding point that has been adjusted be located on the first relationship curve. Since the gamma voltages of all grayscale binding points of the same display panel have the same variation trend along descending or ascending order of the grayscale binding points, the second current grayscale binding point should actually be located on the first relationship curve or close to the first relationship curve. Therefore, the absolute value of the gamma voltage corresponding to the grayscale of the second current grayscale binding point on the first relationship curve should be the absolute value of the actual gamma voltage corresponding to the grayscale of the second current grayscale binding point, or close to the absolute value of the actual gamma voltage corresponding to the grayscale of the second current grayscale binding point. Therefore, the absolute value of the adjusted gamma voltage corresponding to the second current grayscale binding point on the first relationship curve is closer to the absolute value of the actual gamma voltage corresponding to the grayscale corresponding to the second current grayscale binding point. In this way, by determining whether the gamma voltage is reversed and correcting in the case of reversal during the gamma adjustment process, the problem of low grayscale black band, bright band or color shift caused by gamma voltage reversal can be avoided.

Figure 4:
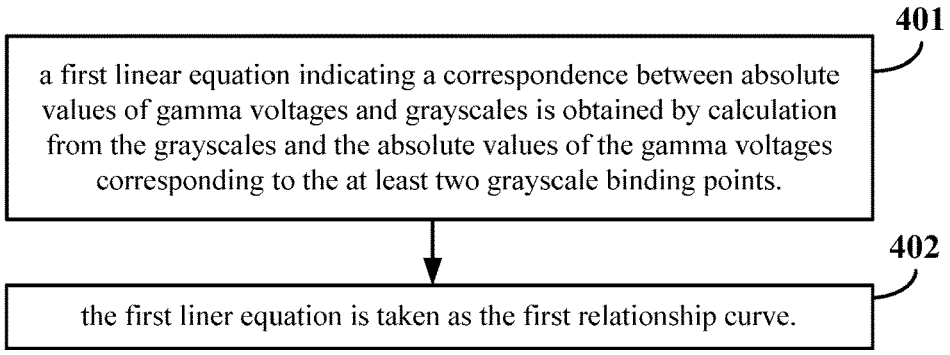
FIG. 4 is a flowchart showing another gamma adjustment method for a display panel according to an embodiment of the present application.

FIG. 4 is a flowchart showing a gamma adjustment method for a display panel according to another embodiment of the present application. In this embodiment, the above at least two grayscale binding points are sequentially adjacent to the above second current grayscale binding point. Based on the embodiment shown in FIG. 1, the above step 108 may include the following steps 401 to 402.

At step 401, a first linear equation indicating a correspondence between absolute values of gamma voltages and grayscales is obtained by calculation from the grayscales and the absolute values of the gamma voltages corresponding to the at least two grayscale binding points.

At step 402, the first liner equation is taken as the first relationship curve.

In this embodiment, from the grayscale binding points that have been gamma adjusted, the gamma adjustment device may obtain absolute values of gamma voltages corresponding to at least two grayscale binding points whose grayscales are respectively larger than that of the second current grayscale binding point. The at least two grayscale binding points whose grayscales are respectively larger than that of the second current grayscale binding point may be sequentially adjacent to the second current grayscale binding point. Specifically, for the at least two grayscale binding points, the interval between the grayscale binding point of the smaller grayscale and the second current grayscale binding point is smaller, and the interval between the grayscale binding point of the larger grayscale and the second current grayscale binding point is larger.

In an embodiment, as shown in FIGS. 2 and 3, the gamma adjustment device may obtain absolute values of the gamma voltages of the grayscale binding points D5, D4, D3 and D2, and may also obtain absolute values of the gamma voltages of the grayscale binding points D3 and D2. When the absolute values of the gamma voltages of the grayscale binding points D3 and D2 are obtained, the grayscale binding points D2 and D3 are sequentially adjacent to the second current grayscale binding point D1. The grayscale of the grayscale binding point D2 is smaller and the grayscale binding point D2 is closer to the second current grayscale binding point D1, while the grayscale of the grayscale binding point D3 is larger and the grayscale binding point D3 is farther from the second current grayscale binding point D1.

In the embodiment, the gamma adjustment device may obtain a first linear equation indicating a correspondence between the absolute values of the gamma voltages and the grayscales by calculation from the grayscales and the absolute values of the gamma voltages corresponding to the at least two grayscale binding points. Part of the at least two grayscale binding points may be located on a straight line corresponding to the first linear equation, and the remaining grayscale binding points may be located outside the straight line corresponding to the first linear equation. In an embodiment, the at least two grayscale binding points may all located outside the straight line corresponding to the first linear equation. In this way, the obtained first linear equation can reflect the relationship between the absolute values of the gamma voltages and the grayscales of the grayscale binding points as a whole.

Optionally, in this embodiment, the above at least two grayscale binding points may include only two grayscale binding points, and the two grayscale binding points are sequentially adjacent to the above second current grayscale binding point. In an embodiment, as shown in FIGS. 2 and 3, the gamma adjustment device may obtain the absolute values of the gamma voltages of the grayscale binding points D3 and D2, and may obtain a first linear equation indicating a correspondence between the absolute values of the gamma voltages and the grayscales by calculation from the grayscales and the absolute values of the gamma voltages corresponding to the grayscale binding points D3 and D2. In this way, the amount of calculation is small, so that the efficiency of gamma adjustment can be improved.

In this embodiment, the gamma adjustment device may take the obtained first linear equation as the above first relationship curve.

In this embodiment, since at least two grayscale binding points are successively adjacent to the second current grayscale binding point, and the absolute values of the gamma voltages corresponding to the adjacent grayscale binding points are approximately in a linear relationship, therefore, the obtained first linear equation by calculation from the grayscales and the absolute values of the gamma voltages corresponding to the at least two grayscale binding points is close to the first relationship curve between the second current grayscale binding point and the above at least two grayscale binding points. Furthermore, the first linear equation is obtained by calculation from the grayscales and the absolute values of the gamma voltages corresponding to the at least two grayscale binding points, which is simple in calculation and less in time consumption, and is beneficial to improve the efficiency of gamma adjustment.

Figure 5:
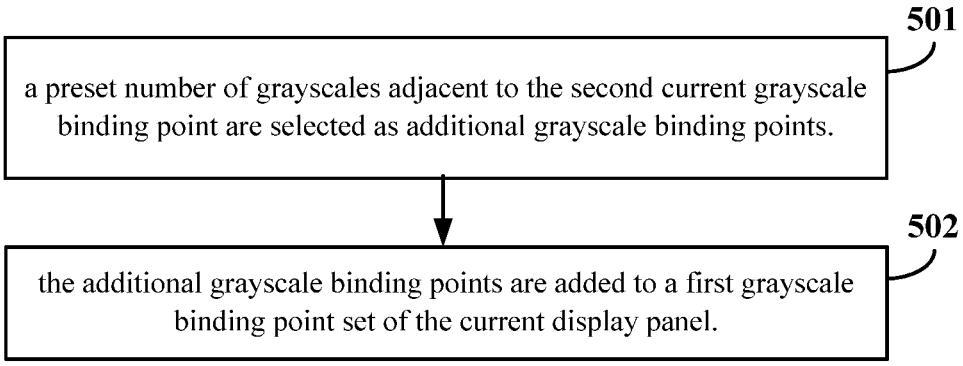
FIG. 5 is a flowchart showing another gamma adjustment method for a display panel according to an embodiment of the present application.

FIG. 5 is a flowchart showing a gamma adjustment method for a display panel according to another embodiment of the present application. In this embodiment, based on the embodiment shown in FIG. 1, after the above step 106, the following steps 501 to 502 may be further included.

At step 501, a preset number of grayscales adjacent to the second current grayscale binding point are selected as additional grayscale binding points.

At step 502, the additional grayscale binding points are added to a first grayscale binding point set of the current display panel.

In an embodiment, each display panel corresponds to one grayscale binding point set, and the grayscale binding point set includes a plurality of grayscale binding points. The gamma adjustment device may perform gamma adjustment on the plurality of grayscale binding points in the grayscale binding point set in a descending order of grayscales.

In this embodiment, when the absolute value of the gamma voltage corresponding to the second current grayscale binding point is smaller than the absolute value of the gamma voltage corresponding to the previous grayscale binding point, the gamma adjustment device may select a preset number of grayscales adjacent to the second current grayscale binding point as additional grayscale points, and add the additional grayscale points to the first grayscale binding point set of the current display panel.

Optionally, the additional grayscale binding points may include a first grayscale binding point with a grayscale smaller than the grayscale of the second current grayscale binding point, or may include a second grayscale binding point with a grayscale larger than the grayscale of the second current grayscale binding point, or may include both a first grayscale binding point with a grayscale smaller than the grayscale of the second current grayscale binding point and a second grayscale binding point with a grayscale larger than the grayscale of the second current grayscale binding point.

The additional grayscale binding points may include a first grayscale binding point with a grayscale smaller than the grayscale of the second current grayscale binding point, or may include a second grayscale binding point with a grayscale larger than the grayscale of the second current grayscale binding point, or may include both the above-mentioned first grayscale binding point and the above-mentioned second grayscale binding point, thus increasing the flexibility and diversity of an selection on the grayscale binding points and gamma adjustment method, to adapt to different emergencies.

Optionally, when the additional grayscale binding points include a second grayscale binding point with a grayscale larger than the grayscale of the second current grayscale binding point, the grayscale of the second grayscale binding point is smaller than the grayscale of the previous grayscale binding point. For example, the previous grayscale binding point of the second current grayscale binding point D1 is the grayscale binding point D2, and the grayscale of the second grayscale binding point is smaller than the grayscale of the grayscale binding point D2.

When the additional grayscale binding points include the second grayscale binding point with a grayscale larger than the grayscale of the second current grayscale binding point, because the grayscale of the second grayscale binding point is smaller than the grayscale of the previous grayscale binding point of the second current grayscale binding point, therefore, an interval between the additional grayscale binding points and the second current grayscale binding point is smaller, so that the additional grayscale binding points are more concentrated.

For example, grayscales of 18 grayscale binding points included in the first grayscale binding point set of the current display panel are 255, 220, 190, 170, 145, 120, 95, 70, 45, 20, 14, 12, 10, 8, 6, 4, 2 and 0, respectively. When the grayscale of the second current grayscale binding point is 20 and the preset number is 4, the gamma adjustment device may select 4 grayscales with grayscales of 24, 22, 18 and 16 as additional grayscale binding points, and add the 4 additional grayscale binding points with grayscales of 24, 22, 18 and 16 to the first grayscale binding point set. The grayscale binding points with grayscales of 18 and 16 are the first grayscale binding points, and the grayscale binding points with grayscales of 22 and 24 are the second grayscale binding points.

In this embodiment, when the absolute value of the gamma voltage corresponding to the second current grayscale binding point is smaller than the absolute value of the gamma voltage corresponding to the previous grayscale binding point, it indicates that there is a problem in the process of finding the gamma voltage corresponding to the second current grayscale binding point. Then, the preset number of grayscales adjacent to the second current grayscale binding point are selected as the additional grayscale binding points and added to the first grayscale binding point set of the current display panel. The gamma adjustment can be performed by taking the preset number of grayscales adjacent to the second current grayscale binding point as additional grayscale binding points, to improve the reliability of gamma adjustment.

Figure 6:
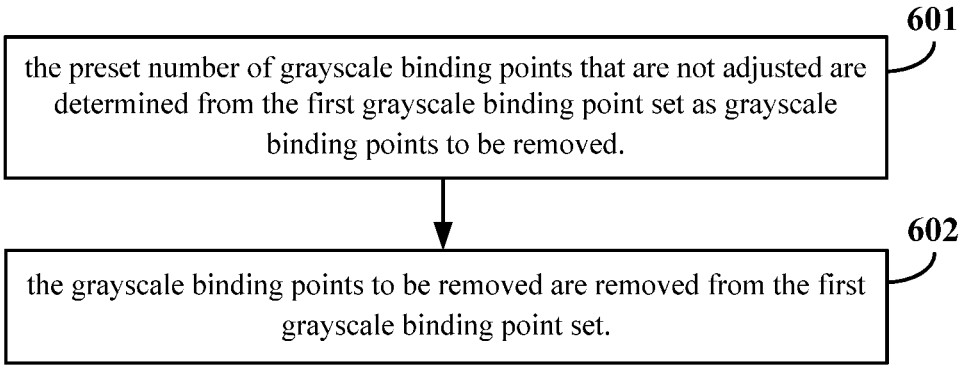
FIG. 6 is a flowchart showing another gamma adjustment method for a display panel according to an embodiment of the present application.

FIG. 6 is a flowchart showing a gamma adjustment method for a display panel according to another embodiment of the present application. In this embodiment, based on the embodiment shown in FIG. 5, after the above step 502, the following steps 601 to 602 may be further included.

At step 601, the preset number of grayscale binding points that are not adjusted are determined from the first grayscale binding point set as grayscale binding points to be removed. The grayscale binding points to be removed and the additional grayscale binding points are different.

At step 602, the grayscale binding points to be removed are removed from the first grayscale binding point set.

In this embodiment, the gamma adjustment device may determine the above-mentioned preset number of grayscale binding points that are not adjusted from the first grayscale binding point set of the current display panel as the grayscale binding points to be removed, and remove the grayscale binding points to be removed from the first grayscale binding point set, so as to keep the total number of grayscale binding points in the first grayscale binding point set unchanged.

For example, the grayscale binding points with grayscales of 14, 10, 6 and 2 in the first grayscale binding point set can be determined as the grayscale binding points to be removed, and the grayscale binding points to be removed are removed from the first grayscale binding point set, to obtain a second grayscale binding point set. 18 grayscale binding points included in the second grayscale binding point set are 255, 220, 190, 170, 145, 120, 95, 70, 45, 24, 22, 20, 18, 16, 12, 8, 4 and 0, respectively.

The preset number of grayscale binding points are added to the first grayscale binding point set, and the same preset number of grayscale binding points are removed from the first grayscale binding point set. In this way, the total number of grayscale binding points in the first grayscale binding point set can be kept unchanged, to prevent the total time of gamma adjustment of a single display panel from being too long, and to improve the efficiency of gamma adjustment.

Optionally, the intervals between adjacent grayscale binding points in the preset number of grayscale binding points to be removed may be substantially the same. For example, the intervals between adjacent grayscale binding points in the grayscale binding points 14, 10, 6 and 2 to be removed are all 4. In an example, the intervals between adjacent grayscale binding points in the preset number of grayscale binding points to be removed may not be completely the same. Since the intervals between adjacent grayscale binding points in the preset number of grayscale binding points to be removed are substantially the same, the distribution of the removed grayscale binding points is uniform, so that the influence of removal of grayscale binding points on the reliability of gamma adjustment can be reduced.

Figure 7:
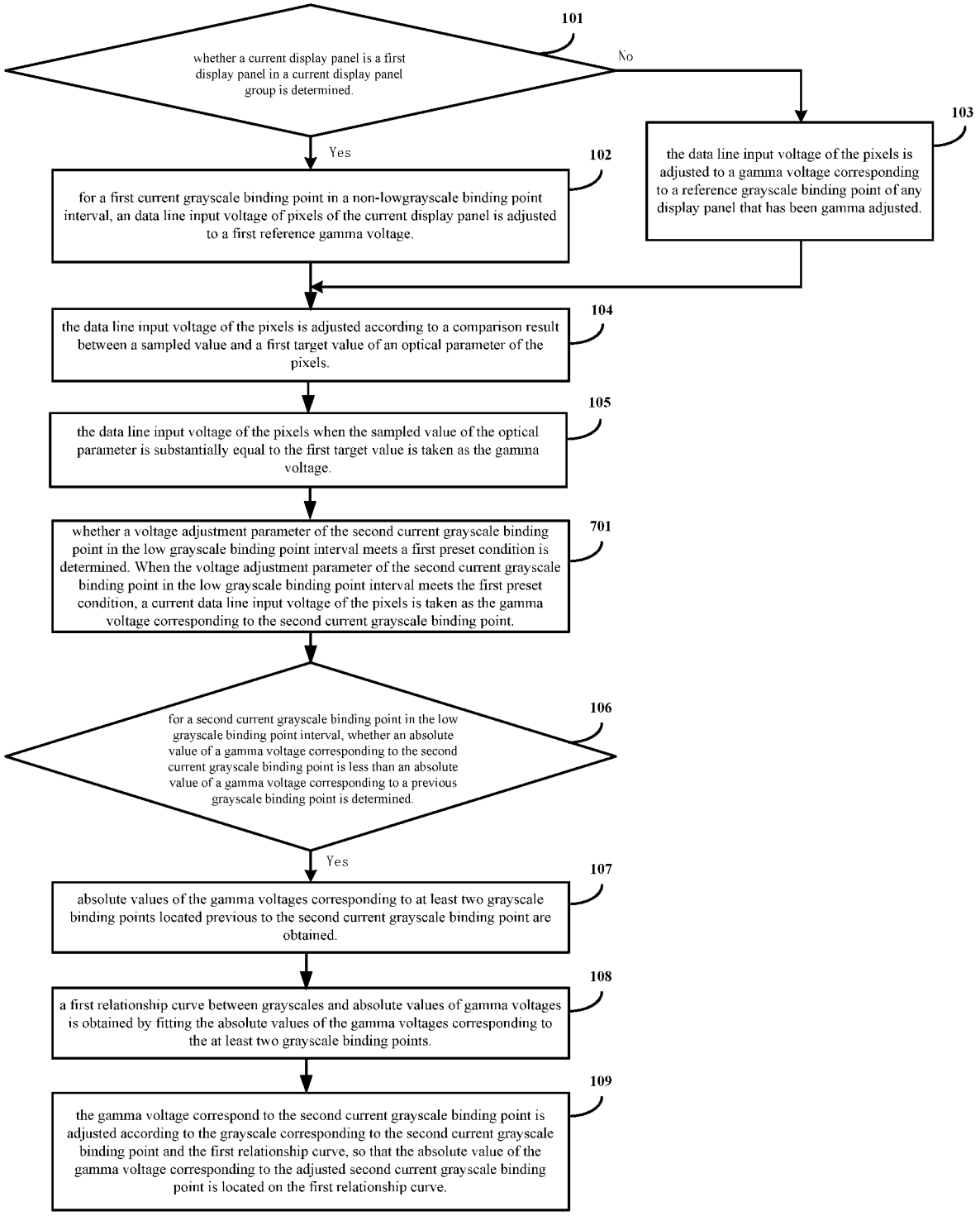
FIG. 7 is a flowchart showing another gamma adjustment method for a display panel according to an embodiment of the present application.

FIG. 7 is a flowchart showing a gamma adjustment method for a display panel according to another embodiment of the present application. In this embodiment, based on the embodiment shown in FIG. 1, before the above step 106, the following step 701 may be further included.

At step 701, whether a voltage adjustment parameter of the second current grayscale binding point in the low grayscale binding point interval meets a first preset condition is determined. When the voltage adjustment parameter of the second current grayscale binding point in the low grayscale binding point interval meets the first preset condition, a current data line input voltage of the pixels is taken as the gamma voltage corresponding to the second current grayscale binding point.

In this embodiment, when the voltage adjustment parameter of the second current grayscale binding point in the low grayscale binding point interval conforms to the first preset condition, the adjustment may be suspended, that is, the performance of steps 106 to 109 is suspended, and the current data line input voltage of the pixels is taken as the gamma voltage corresponding to the second current grayscale binding point. In this way, problems can be found in time to avoid wasting time.

Optionally, the voltage adjustment parameter is a number of voltage adjustment times, and the first preset condition is that the number of voltage adjustment times is greater than a preset number of times. Since the number of voltage adjustment times of the second current grayscale binding point can indirectly reflect a duration of the gamma adjustment of the second current grayscale binding point, the number of voltage adjustment times of the second current grayscale binding point being greater than the preset number of times is taken as the first preset condition, which is easy to implement and higher in accuracy.

Optionally, the voltage adjustment parameter is a duration of voltage adjustment, and the first preset condition is that the duration of voltage adjustment is longer than a preset duration. Since the duration of voltage adjustment of the second current grayscale binding point can directly reflect a duration of the gamma adjustment of the second current grayscale binding point, the duration of voltage adjustment of the second current grayscale binding point being longer than the preset duration is taken as the first preset condition, which is higher in accuracy.

Optionally, when the voltage adjustment parameter of the second current grayscale binding point meets the first preset condition, a prompt message for prompting an adjustment abnormality is output. Since the prompt information for prompting the adjustment abnormality can be output when the voltage adjustment parameter of the second current grayscale binding point meets the first preset condition, the tester can be prompted to pay more attention in the subsequent test.

Figure 8:
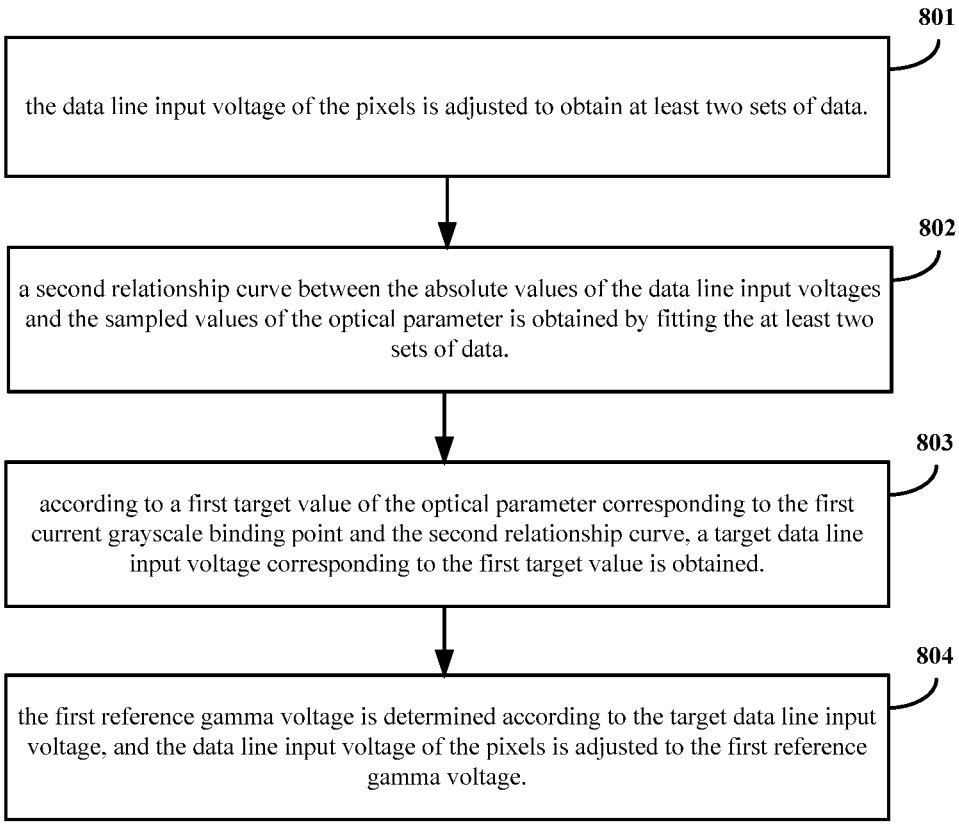
FIG. 8 is a flowchart showing another gamma adjustment method for a display panel according to an embodiment of the present application.

FIG. 8 is a flowchart showing a gamma adjustment method for a display panel according to another embodiment of the present application. Based on the embodiment shown in FIG. 1, the above step 102 may include the following steps 801 to 804.

At step 801, the data line input voltage of the pixels is adjusted to obtain at least two sets of data. The sampled value of the optical parameter of the pixels will change as the data line input voltage of the pixels changes. The at least two sets of data include absolute values of at least two data line input voltages and corresponding sampled values of the optical parameter.

In this embodiment, the gamma adjustment device may adjust the data line input voltage of the pixels, to obtain two or more sets of data. Each set of data includes an absolute value of a data line input voltage and a corresponding sampled value of an optical parameter. Hereinafter, obtaining three sets of data by adjusting the data line input voltage of the pixels is taken as an example. When adjusting the data line input voltage of the pixels, three sets of data (V1, L1), (V2, L2) and (V3, L3) can be obtained, where V is the data line input voltage and L is the sampled value of the optical parameter.

At step 802, a second relationship curve between the absolute values of the data line input voltages and the sampled values of the optical parameter is obtained by fitting the at least two sets of data.

In this embodiment, the gamma adjustment device may perform data fitting on the obtained at least two sets of data to obtain the second relationship curve between the absolute values of the data line input voltages and the sampled values of the optical parameter. Where, part of the at least two sets of data may be located on the second relationship curve, and the other part may be located around the second relationship curve, or the at least two sets of data may all be located on the second relationship curve, or the at least two sets of data may all be located around the second relationship curve.

At step 803, according to a first target value of the optical parameter corresponding to the first current grayscale binding point and the second relationship curve, a target data line input voltage corresponding to the first target value is obtained.

In this embodiment, the gamma adjusting device may obtain the target data line input voltage corresponding to the first target value according to the first target value of the optical parameter corresponding to the first current grayscale binding point and the above-mentioned second relationship curve.

At step 804, the first reference gamma voltage is determined according to the target data line input voltage, and the data line input voltage of the pixels is adjusted to the first reference gamma voltage.

In this embodiment, the gamma adjustment device may take the obtained target data line input voltage as the first reference gamma voltage, and adjust the data line input voltage of the pixels to the first reference gamma voltage.

In an embodiment, the optical parameter may be luminance, or the optical parameter may be color coordinate, or the optical parameter may include both luminance and color coordinate, thus increasing the flexibility and diversity of selecting optical parameters to meet the accuracy requirements of different gamma adjustments. When the above-mentioned optical parameter includes both luminance and color coordinate, the obtained gamma voltage is more accurate.

In an embodiment, in the case that the optical parameter includes luminance, when adjusting the gamma voltage of the pixels of a color, the sampled value of the luminance of the pixels is the sampled value of the luminance of the pixel unit, that is, a sampled value of the luminance of the display panel. Since the above-mentioned sampled value of the luminance corresponding to the data line input voltage of the pixels is the sampled value of the luminance of the pixel unit, a value of the display luminance of the display panel can be directly sampled as the luminance value of the pixel of any color, thus reducing the difficulty of the sampling of luminance and improving the efficiency of gamma adjustment.

In this embodiment, at least two sets of data are obtained by adjusting the data line input voltage of the pixels, and the second relationship curve between the absolute values of the data line input voltages and the sampled values of the optical parameter is obtained by fitting the at least two sets of data. Then, the target data line input voltage corresponding to the first target value can be obtained according to the first target value of the optical parameter corresponding to the first current grayscale binding point and the above-mentioned second relationship curve. The first reference gamma voltage is determined according to the target data line input voltage, and the data line input voltage of the pixels is adjusted to the first reference gamma voltage. In this way, the gamma voltage corresponding to the first current grayscale binding point can be quickly approached.

Figure 9:
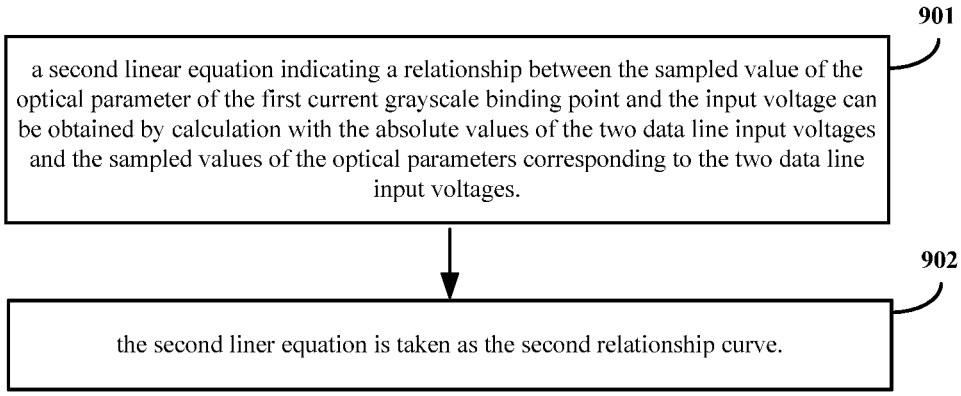
FIG. 9 is a flowchart showing another gamma adjustment method for a display panel according to an embodiment of the present application.

FIG. 9 is a flowchart showing a gamma adjustment method for a display panel according to another embodiment of the present application. In this embodiment, the at least two sets of data include two sets of data, and the two sets of data include the absolute values of two data line input voltages and the sampled values of the optical parameter corresponding to the two data line input voltages. The absolute values of the two data line input voltages are both greater than the absolute value of the target data line input voltage. Based on the embodiment shown in FIG. 8, the above step 802 may include the following steps 901 to 902.

At step 901, a second linear equation indicating a relationship between the sampled value of the optical parameter of the first current grayscale binding point and the input voltage can be obtained by calculation with the absolute values of the two data line input voltages and the sampled values of the optical parameters corresponding to the two data line input voltages.

At step 902, the second liner equation is taken as the second relationship curve.

In this embodiment, the gamma adjustment device may adjust the data line input voltage according to a direction from high voltage to low voltage, to obtain two or more sets of data. Each set of data include an absolute value of a data line input voltage and a corresponding sampled value of an optical parameter. The absolute values of the data line input voltages in each set of data are greater than the absolute value of the target data line input voltage. In this way, the data line input voltage can be adjusted in one direction, and the gamma voltage can be gradually approached, which is beneficial to improve the adjustment efficiency.

In this embodiment, the gamma adjustment device may select two sets of data from the obtained data, and then determine the above-mentioned second linear equation based on the two sets of data. For example, the gamma adjustment device can obtain three sets of data (V1, L1), (V2, L2) and (V3, L3) in sequence, select (V1, L1) and (V3, L3) from the three sets of data, and obtain the following second linear equation according to (V1, L1) and (V3, L3):

$$V = \frac{L - L3}{\text{step}} + V3 \tag{1}$$

In equation (1), $$\text{step} = \frac{L3 - L1}{V3 - V1}$$

The gamma adjustment device may take the second liner equation as the second relationship curve.

In this embodiment, the gamma adjusting device may obtain the target data line input voltage corresponding to the first target value according to the first target value T1 of the optical parameter corresponding to the first current grayscale binding point and the above-mentioned second relationship curve. For example, when the second relationship curve is the linear equation expressed by the above-mentioned equation (1), the target data line input voltage Vt corresponding to the first target value is:

$$Vt = \frac{T1 - L3}{\text{step}} + V3 \quad (2)$$

In this embodiment, the gamma adjustment device may take the obtained target data line input voltage Vt as the first reference gamma voltage, and adjust the data line input voltage of the pixels to the first reference gamma voltage.

In this embodiment, the above second linear equation can be obtained by calculation with the absolute values of the two data line input voltages and the sampled values of the optical parameter corresponding to the two data line input voltages, which is easy to implement and the calculation speed is fast, therefore, taking the second linear equation obtained by calculation as the above-mentioned second relationship curve can improve the efficiency of gamma adjustment.

Figure 10:
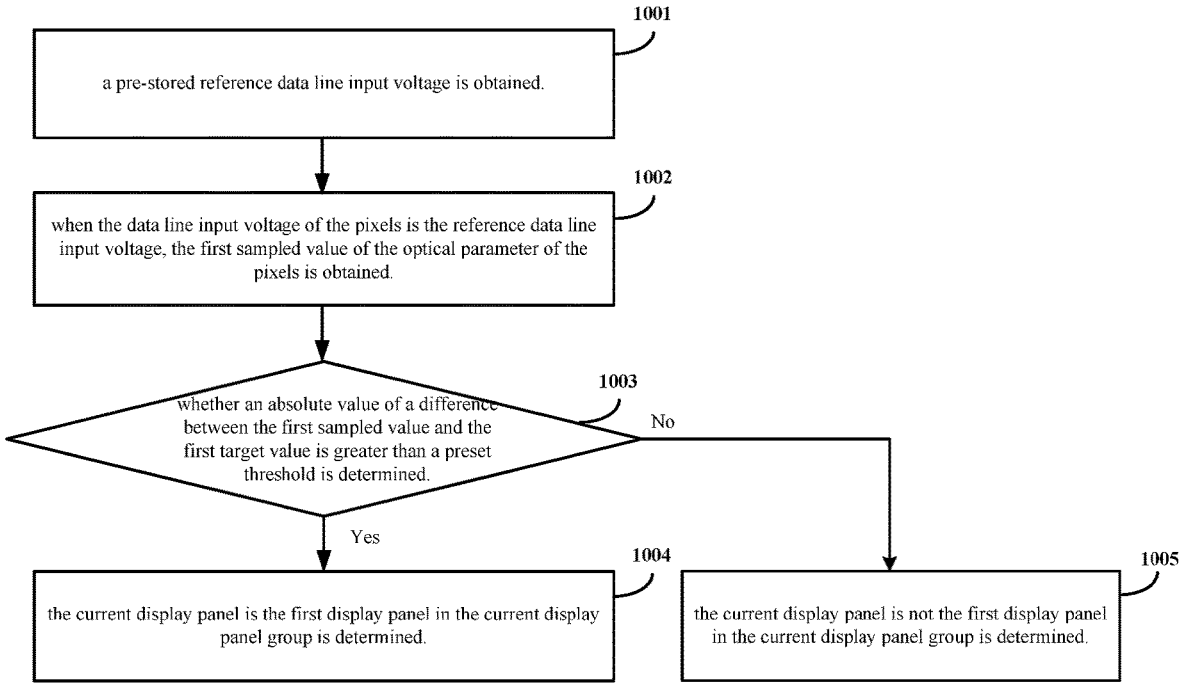
FIG. 10 is a flowchart showing another gamma adjustment method for a display panel according to an embodiment of the present application.

FIG. 10 is a flowchart showing a gamma adjustment method for a display panel according to another embodiment of the present application. Based on the embodiment shown in FIG. 1, the above step 101 may include the following steps 1001 to 1005.

At step 1001, a pre-stored reference data line input voltage is obtained.

In an embodiment, the reference data line input voltage may be a default value pre-stored in a gamma voltage register. Since the reference data line input voltage is pre-stored in the gamma voltage register of each display panel, the reference data line input voltage pre-stored in the gamma voltage register may be read during a process of gamma adjustment, and the data line input voltage of the pixels may be adjusted to the above-mentioned reference data line input voltage to drive the pixels to emit light. Whether the current display panel is the first display panel in the current display panel group is determined by comparing a first sampled value and the first target value of the optical parameter of the pixels, which is easy to implement and has strong applicability.

In another embodiment, the reference data line input voltage may be a gamma voltage corresponding to a reference grayscale binding point of any display panel that has been gamma adjusted, and the gamma voltage is pre-stored in the gamma adjustment device. Respective gamma voltages corresponding to the grayscales of any display panel that has been gamma adjusted can be stored in the gamma adjustment device. During the process of gamma adjustment for the display panel, the gamma adjustment device takes the grayscale having a same grayscale as that of the first current grayscale binding point of the current display panel as a reference grayscale binding point, and the gamma voltage corresponding to the reference grayscale binding point is taken as the above-mentioned reference data line input voltage. Since the gamma voltage corresponding to the same grayscale of each display panel in the same display panel group is substantially the same, the time of the gamma adjustment for the display panel can be shortened, and the efficiency of the gamma adjustment can be improved.

Optionally, any one of the above-mentioned display panels that has been gamma adjusted may be a display panel with a minimum time interval between the gamma adjustment time and the current time in the display panels that have been gamma adjusted. Since the gamma adjustment condition of the display panel with a minimum time interval between the gamma adjustment time and the current time in the display panels that have been gamma adjusted is the closest to the gamma adjustment condition of the current display panel, the reference value is relatively large, the gamma adjustment time of the display panel can be further shorten, and the efficiency of gamma adjustment can be improved.

At step 1002, when the data line input voltage of the pixels is the reference data line input voltage, the first sampled value of the optical parameter of the pixels is obtained.

In this embodiment, the gamma adjustment device may adjust the data line input voltage of the pixels to the reference data line input voltage, and obtain the first sampled value of the optical parameter of the pixels by the optical measuring instrument.

At step 1003, whether an absolute value of a difference between the first sampled value and the first target value is greater than a preset threshold is determined. When the absolute value of the difference between the first sampled value and the first target value is greater than the preset threshold, step 1004 is performed. When the absolute value of the difference between the first sampled value and the first target value is less than or equal to the preset threshold, step 1005 is performed.

In an embodiment, the gamma adjustment device may compare the first sampled value with the first target value, and determine whether the absolute value of the difference between the first sampled value and the first target value is greater than the preset threshold. When the absolute value of the difference between the first sampled value and the first target value is greater than the preset threshold, it is indicated that the distance between the first sampled value and the first target value is far, then step 1004 is performed. When the absolute value of the difference between the first sampled value and the first target value is less than or equal to the preset threshold, it is indicated that the distance between the first sampled value and the first target value is relatively short, then step 1005 is performed.

At step 1004, the current display panel is the first display panel in the current display panel group is determined.

In this embodiment, when the absolute value of the above difference is greater than the preset threshold, the gamma adjustment device may determine that the current display panel is the first display panel in the current display panel group.

At step 1005, the current display panel is not the first display panel in the current display panel group is determined.

In this embodiment, when the absolute value of the above difference is less than or equal to the preset threshold, the gamma adjustment device may determine that the current display panel is not the first display panel in the current display panel group.

In this embodiment, when the data line input voltage of the pixels is the pre-stored reference data line input voltage, the first sampled value of the optical parameter of the pixels is obtained. When the absolute value of the difference between the first sampled value and the first target value is greater than the preset threshold, it is indicated that the pre-stored reference data line input voltage is not an reference data line input voltage obtained by gamma adjustment, and that the current display panel is the first display panel in the current display panel group is determined. When the absolute value of the difference between the first sampled value and the first target value is less than or equal to the preset threshold, which it is indicated that the pre-stored reference data line input voltage is a reference data line input voltage obtained by gamma adjustment for other display panels in the current display panel group, and that the current display panel is not the first display panel in the current display panel group is determined. Driving the pixels to emit light by the pre-stored reference data line input voltage and determining whether the current display panel is the first display panel in the current display panel group by comparing a first sampled value and the first target value of the optical parameter of the pixels is easy to implement and has strong applicability.

Figure 11:
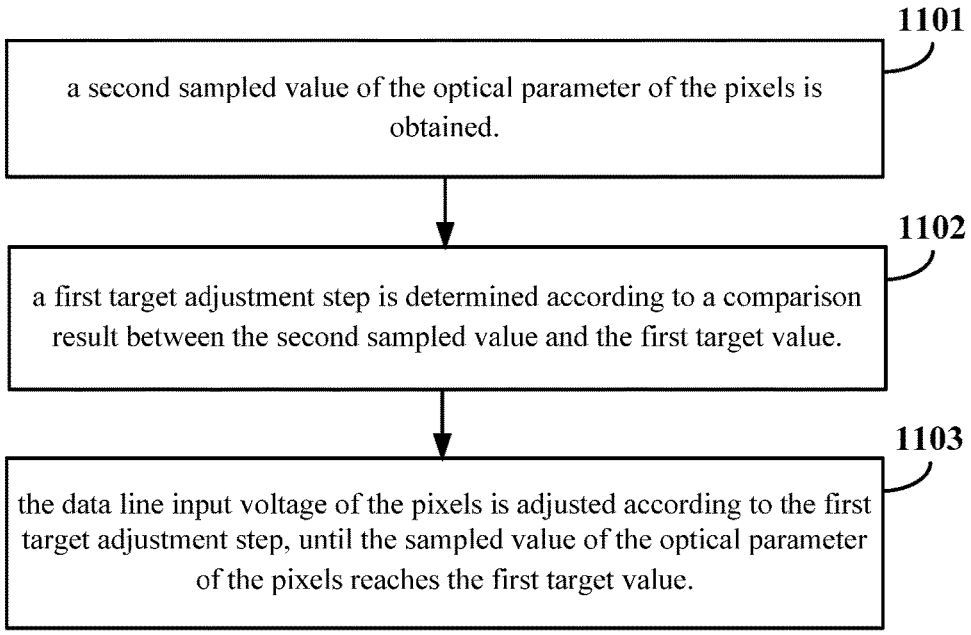
FIG. 11 is a flowchart showing another gamma adjustment method for a display panel according to an embodiment of the present application.

FIG. 11 is a flowchart showing a gamma adjustment method for a display panel according to another embodiment of the present application. In this embodiment, based on the embodiment shown in FIG. 1, the above step 104 may include the following steps 1101 to 1103.

At step 1101, a second sampled value of the optical parameter of the pixels is obtained.

At step 1102, a first target adjustment step is determined according to a comparison result between the second sampled value and the first target value.

At step 1103, the data line input voltage of the pixels is adjusted according to the first target adjustment step, until the sampled value of the optical parameter of the pixels reaches the first target value.

In this embodiment, the gamma adjustment device may obtain the second sampled value of the optical parameter of the pixels by the optical measuring instrument, determine the first target adjustment step according to the comparison result between the second sampled value and the first target value, and then adjust the data line input voltage of the pixels according to the first target adjustment step, until the sampled value of the optical parameter of the pixels reaches the first target value.

In this embodiment, by comparing the second sampled value of the optical parameter of the pixels and the first target value, the first target adjustment step can be determined according to the comparison result, and the data line input voltage of the pixels can be adjusted according to the first target adjustment step, until the sampled value of the optical parameter of the pixels reaches the first target value. In this way, an appropriate adjustment step can be determined, and a longer adjustment duration caused by an improper adjustment step can be avoided.

Figure 12:
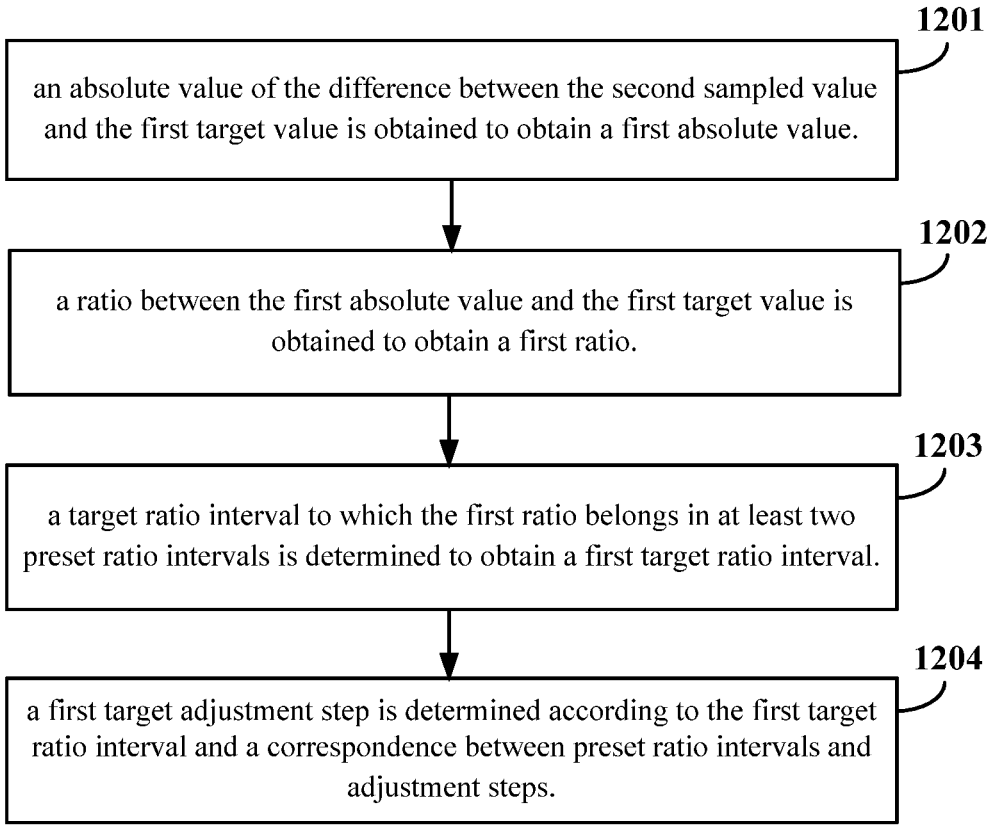
FIG. 12 is a flowchart showing another gamma adjustment method for a display panel according to an embodiment of the present application.

FIG. 12 is a flowchart showing a gamma adjustment method for a display panel according to another embodiment of the present application. In this embodiment, based on the embodiment shown in FIG. 11, the above step 1102 may include the following steps 1201 to 1204.

At step 1201, an absolute value of the difference between the second sampled value and the first target value is obtained to obtain a first absolute value.

At step 1202, a ratio between the first absolute value and the first target value is obtained to obtain a first ratio.

At step 1203, a target ratio interval to which the first ratio belongs in at least two preset ratio intervals is determined to obtain a first target ratio interval.

At step 1204, a first target adjustment step is determined according to the first target ratio interval and a correspondence between preset ratio intervals and adjustment steps.

In this embodiment, the gamma adjustment device may obtain the absolute value of the difference between the second sampled value and the first target value to obtain the first absolute value, and then obtain the ratio between the first absolute value and the first target value to obtain the first ratio. The first ratio indicates the degree of deviation between the second sampled value and the first target value.

In this embodiment, the gamma adjustment device may pre-store three ratio intervals [30%, +∞), (5%, 30%], and [0, 5%). Each ratio interval corresponds to one adjustment step. The step values of the adjustment steps corresponding to the ratio intervals [30%, +∞), (5%, 30%] and [0, 5%) are respectively a first step value, a second step value and a third step value. The first step value is greater than the second step value, and the second step value is greater than the third step value.

In this embodiment, the gamma adjustment device may determine the target ratio interval to which the first ratio belongs to obtain the first target ratio interval, and obtain the first target adjustment step according to the first target ratio interval and the correspondence between preset ratio intervals and adjustment steps. When the first target ratio interval is [30%, +∞), the step value of the first target adjustment step is the first step value. When the first target ratio interval is (5%, 30%), the step value of the first target adjustment step is the second step value. When the first target ratio interval is [0, 5%), the step value of the first target adjustment step is the third step value. For example, when the first ratio is 40%, the ratio interval to which the first ratio belongs is [30%, +∞), that is, the first target ratio interval is [30%, +∞), then the step value of the first target adjustment step is the first step value.

When the ratio in the first target ratio interval is larger, the step value of the corresponding first target adjustment step is larger. Therefore, when the degree of deviation between the second sampled value and the first target value is larger, a relatively large adjustment step can be adopted, which is beneficial to shorten the adjustment time. When the ratio in the first target ratio interval is smaller, the step value of the corresponding first target adjustment step is smaller. Therefore, when the degree of deviation between the second sampled value and the first target value is smaller, a relatively small adjustment step can be adopted to avoid a longer adjustment duration result from a larger adjustment step.

In this embodiment, by obtaining the absolute value of the difference between the above second sampled value and the above first target value and the first ratio between the above first absolute value and the above first target value, the degree of deviation between the second sampled value and the first target value can be determined. Then, the first target ratio interval to which the first ratio belongs in at least two preset ratio intervals can be determined, and the degree of deviation corresponding to each ratio interval is different. And then, the first target adjustment step is determined according to the first target ratio interval and the correspondence between preset ratio intervals and adjustment steps. In this way, a corresponding adjustment step can be determined according to the degree of deviation between the second sampled value and the first target value, so that the adjustment step is moderate.

Figure 13:
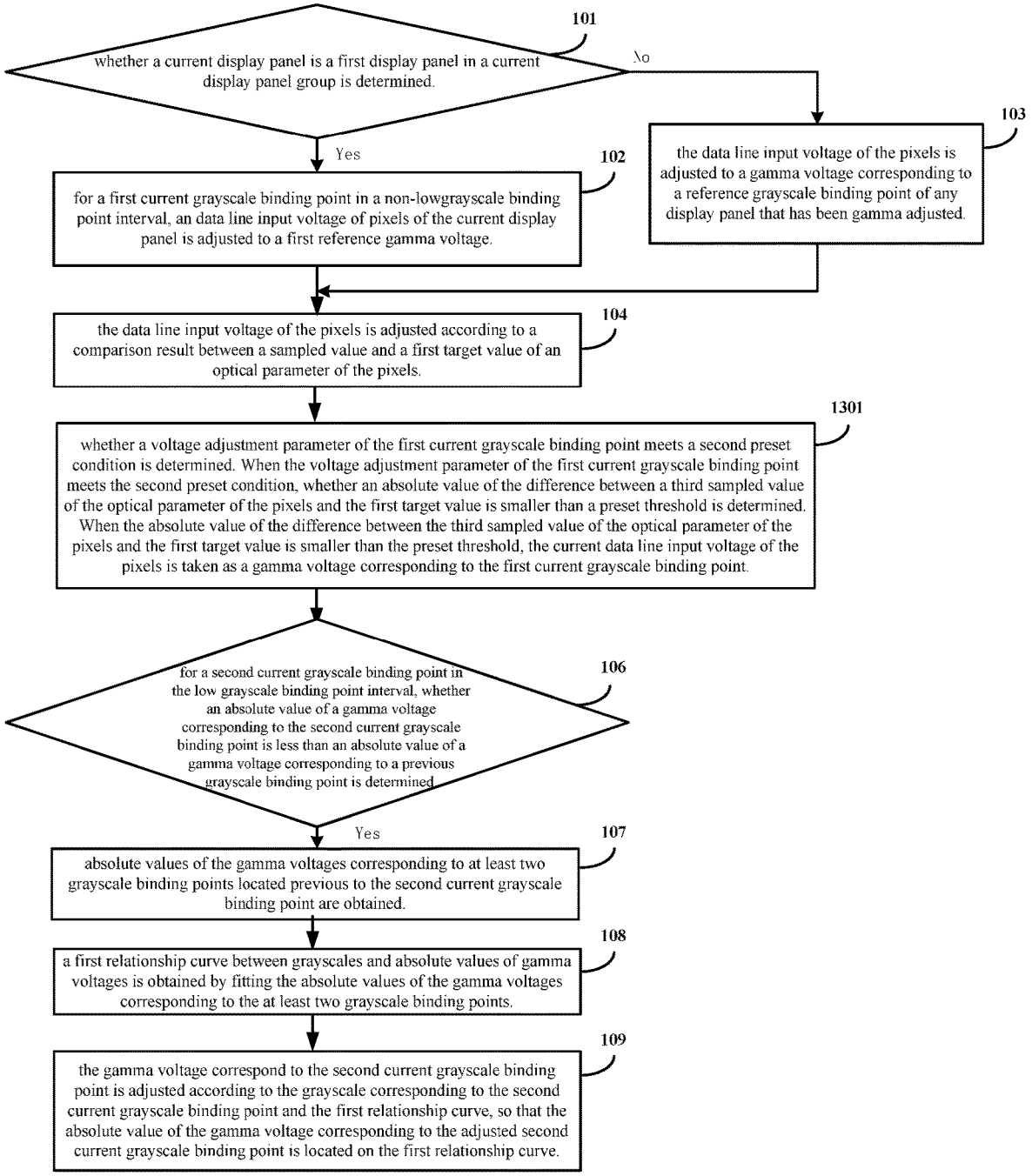
FIG. 13 is a flowchart showing another gamma adjustment method for a display panel according to an embodiment of the present application.

FIG. 13 is a flowchart showing a gamma adjustment method for a display panel according to another embodiment of the present application. In this embodiment, based on the embodiment shown in FIG. 1, after the above step 104, the following step 1301 may be further included, which replaces the step 105 shown in FIG. 1.

At step 1301, whether a voltage adjustment parameter of the first current grayscale binding point meets a second preset condition is determined. When the voltage adjustment parameter of the first current grayscale binding point meets the second preset condition, whether an absolute value of the difference between a third sampled value of the optical parameter of the pixels and the first target value is smaller than a preset threshold is determined. When the absolute value of the difference between the third sampled value of the optical parameter of the pixels and the first target value is smaller than the preset threshold, the current data line input voltage of the pixels is taken as a gamma voltage corresponding to the first current grayscale binding point.

In this embodiment, the gamma adjustment device may determine whether the voltage adjustment parameter of the first current grayscale binding point meets the second preset condition in the process of fine-tuning gamma voltages of the grayscale binding points in the non-low grayscale interval. When it is determined that the voltage adjustment parameter of the first current grayscale binding point meets the second preset condition, whether the absolute value of the difference between the third sampled value of the optical parameter of the pixels and the first target value is smaller than the preset threshold is determined. When it is determined that the absolute value of the difference between the third sampled value of the optical parameter of the pixels and the first target value is smaller than the preset threshold, which indicates that the sampled value of the optical parameter of the pixels is substantially the same as the first target value, the current data line input voltage of the pixels is taken as a gamma voltage corresponding to the first current grayscale binding point.

In an embodiment, the voltage adjustment parameter is a number of voltage adjustment times, and the second preset condition is that the number of voltage adjustment times is greater than a preset number of times. Since the number of voltage adjustment times of the first current grayscale binding point can indirectly reflect a duration of the gamma adjustment of the first current grayscale binding point, taking the number of voltage adjustment times of the first current grayscale binding point being greater than the preset number of times as the second preset condition is easy to implement and high in accuracy.

In a further embodiment, the voltage adjustment parameter is a duration of voltage adjustment, and the second preset condition is that the duration of voltage adjustment is longer than a preset duration. Since the duration of voltage adjustment of the first current grayscale binding point can directly reflect a duration of the gamma adjustment of the first current grayscale binding point, taking the duration of voltage adjustment of the first current grayscale binding point being longer than the preset duration as the second preset condition is higher in accuracy.

Optionally, when the voltage adjustment parameter of the current grayscale binding point meets the second preset condition is determined by the gamma adjustment device, a prompt message for prompting an adjustment abnormality is output. Since the prompt information for prompting the adjustment abnormality can be output when the voltage adjustment parameter of the first current grayscale binding point meets the second preset condition, the tester can be prompted to pay more attention in the subsequent test.

In this embodiment, when the voltage adjustment parameter of the first current grayscale binding point meets the second preset condition, and the absolute value of the difference between the third sampled value of the optical parameter of the pixels and the first target value is smaller than the preset threshold, the current data line input voltage of the pixels is taken as the gamma voltage corresponding to the first current grayscale binding point. In this way, problems can be found in time to avoid wasting time.

Figure 14:
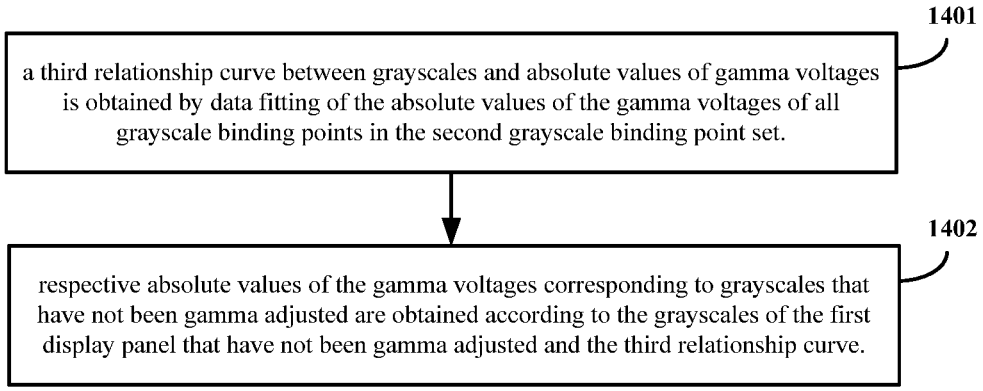
FIG. 14 is a flowchart showing another gamma adjustment method for a display panel according to an embodiment of the present application.

FIG. 14 is a flowchart showing a gamma adjustment method for a display panel according to another embodiment of the present application. In this embodiment, based on the embodiment shown in FIG. 1, after all grayscale binding points in the second grayscale binding point set of the first display panel have been gamma adjusted, that is, after the above step 109, the following steps 1401 to 1402 may be further included.

At step 1401, a third relationship curve between grayscales and absolute values of gamma voltages is obtained by data fitting of the absolute values of the gamma voltages of all grayscale binding points in the second grayscale binding point set.

At step 1402, respective absolute values of the gamma voltages corresponding to grayscales that have not been gamma adjusted are obtained according to the grayscales of the first display panel that have not been gamma adjusted and the third relationship curve.

In this embodiment, after all the grayscale binding points in the second grayscale binding point set of the first display panel have been gamma adjusted, the gamma adjustment device may perform data fitting for the absolute values of the gamma voltages of all the grayscale binding points in the second grayscale binding point set, to obtain the third relationship curve between grayscales and absolute values of the gamma voltages. Then, the gamma adjustment device may obtain the respective absolute values of the gamma voltages corresponding to the grayscales that have not been gamma adjusted according to the grayscales of the first display panel that have not been gamma adjusted and the third relationship curve. For example, grayscales of 18 grayscale binding points included in the second grayscale binding point set of the first display panel are 255, 220, 190, 170, 145, 120, 95, 70, 45, 24, 22, 20, 18, 16, 12, 8, 4 and 0, respectively. Grayscales that have not been gamma adjusted in the first display panel are the remaining grayscales of 0~255 except the above 18 grayscales. The gamma register of the first display panel may perform data fitting on the absolute values of the gamma voltages of the above 18 grayscale binding points to obtain the third relationship curve between grayscales and absolute values of gamma voltages. Then, the respective absolute values of the gamma voltages corresponding to the grayscales that have not been gamma adjusted are obtained according to the grayscales of the first display panel that have not been gamma adjusted and the third relationship curve.

In this embodiment, by performing data fitting for the absolute values of the gamma voltages of all the grayscale binding points in the second grayscale binding point set of the first display panel, the third relationship curve between grayscales and absolute values of gamma voltages can be obtained. Then, according to the grayscales of the first display panel that have not been gamma adjusted and the third relationship curve, the respective absolute values of the gamma voltages corresponding to the grayscales that have not been gamma adjusted can be obtained. In this way, it is unnecessary to gamma adjust each grayscale binding point, which greatly shortens the time for gamma adjustment.

Figure 15:
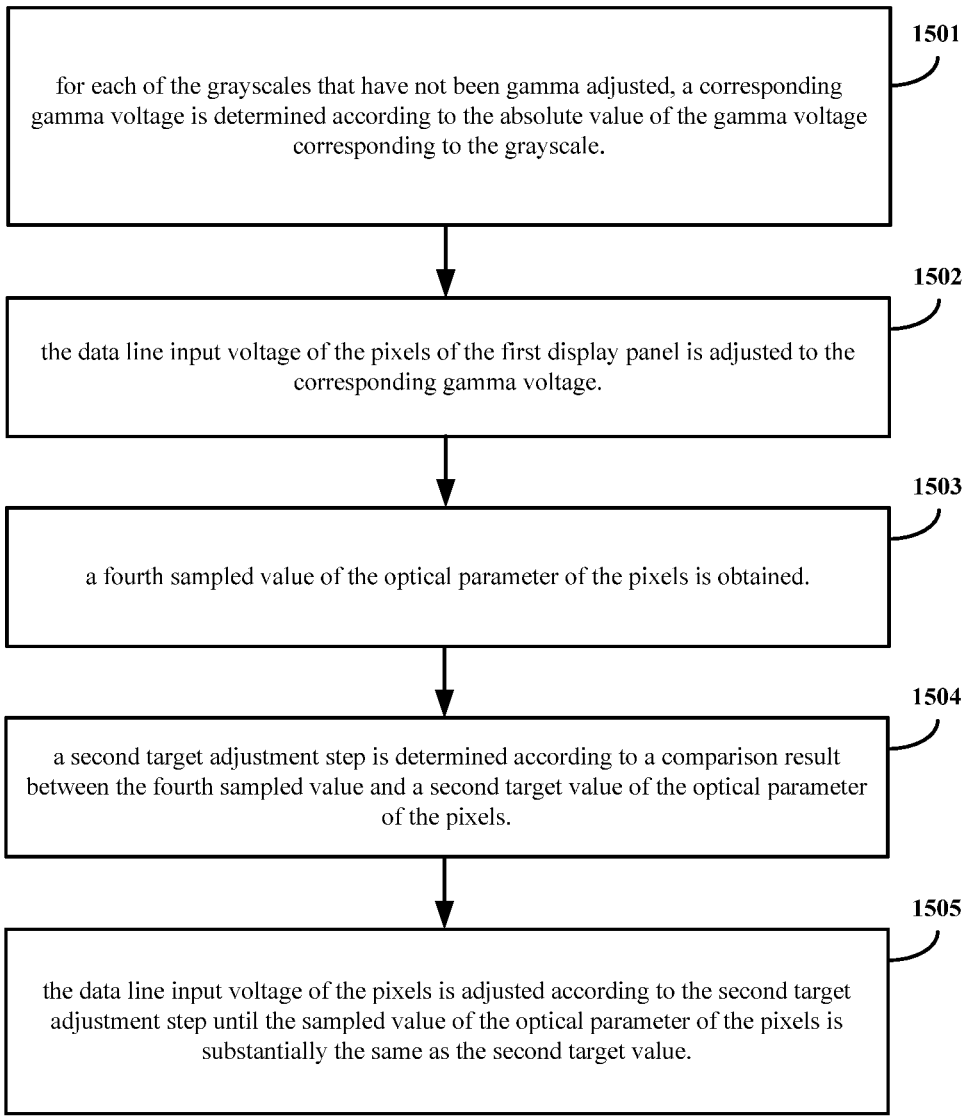
FIG. 15 is a flowchart showing another gamma adjustment method for a display panel according to an embodiment of the present application.

FIG. 15 is a flowchart showing a gamma adjustment method for a display panel according to another embodiment of the present application. In this embodiment, based on the embodiment shown in FIG. 14, after the above step 1402, the following steps 1501 to 1505 may be further included.

At step 1501, for each of the grayscales that have not been gamma adjusted, a corresponding gamma voltage is determined according to the absolute value of the gamma voltage corresponding to the grayscale.

At step 1502, the data line input voltage of the pixels of the first display panel is adjusted to the corresponding gamma voltage.

At step 1503, a fourth sampled value of the optical parameter of the pixels is obtained.

At step 1504, a second target adjustment step is determined according to a comparison result between the fourth sampled value and a second target value of the optical parameter of the pixels.

At step 1505, the data line input voltage of the pixels is adjusted according to the second target adjustment step until the sampled value of the optical parameter of the pixels is substantially the same as the second target value.

Since the absolute value of the gamma voltage of each of the grayscales that have not been gamma adjusted is obtained by data fitting, rather than measurement, the gamma voltage determined according to the absolute value of the gamma voltage obtained by data fitting may not be accurate and has a certain error. In order to make the gamma voltage of each of the grayscales that have not been gamma adjusted more accurate, the gamma voltage obtained by data fitting can be fine-tuned to obtain a more accurate gamma voltage.

In this embodiment, for each of the grayscales that have not been gamma adjusted, the gamma adjustment device may determine the gamma voltage corresponding to each grayscale according to the absolute value of the corresponding gamma voltage, and adjust the data line input voltage of the pixels of the first display panel to the corresponding gamma voltage. The gamma adjustment device may obtain a fourth sampled value of the optical parameter of the pixels, determine the second target adjustment step according to a comparison result between the fourth sampled value and the second target value of the optical parameter of the pixels, and then adjust the data line input voltage of the pixels according to the second target adjustment step until the sampled value of the optical parameter of the pixels is substantially the same as the second target value.

In this embodiment, for each of the grayscales that have not been gamma adjusted, the gamma voltage corresponding to the each of the grayscales that have not been gamma adjusted is determined according to the absolute value of the corresponding gamma voltage, and the data line input voltage of the pixels of the first display panel is adjusted to the corresponding gamma voltage. Then the second target adjustment step is determined according to a comparison result between the fourth sampled value of the optical parameter of the pixels and the second target value of the optical parameter of the pixels, and the data line input voltage of the pixels is adjusted according to the second target adjustment step until the sampled value of the optical parameter of the pixels substantially reaches the second target value. In this way, the gamma voltage corresponding to each of the grayscales that have not been gamma adjusted and obtained by data fitting can be fine-tuned to obtain a more accurate gamma voltage.

In an embodiment, the current display panel group may include at least one display panel. The respective grayscale binding point sets corresponding to the at least one display panel are the same or different. That is, when all the grayscales of the first display panel have been gamma adjusted, the respective grayscale binding point sets of a plurality non-first display panels can be the same as or different from the grayscale binding point set of the first display panel. The grayscale binding point sets corresponding to all the display panels respectively in the current display panel group can be the same or different, which increases the flexibility and diversity of selecting grayscale binding points and gamma adjustment methods to adapt to different emergencies. When the grayscale binding point sets corresponding to all the display panels respectively in the current display panel group are different, it is more beneficial to find the grayscale binding points with problems, so as to focus on them in subsequent testing.

Figure 16:
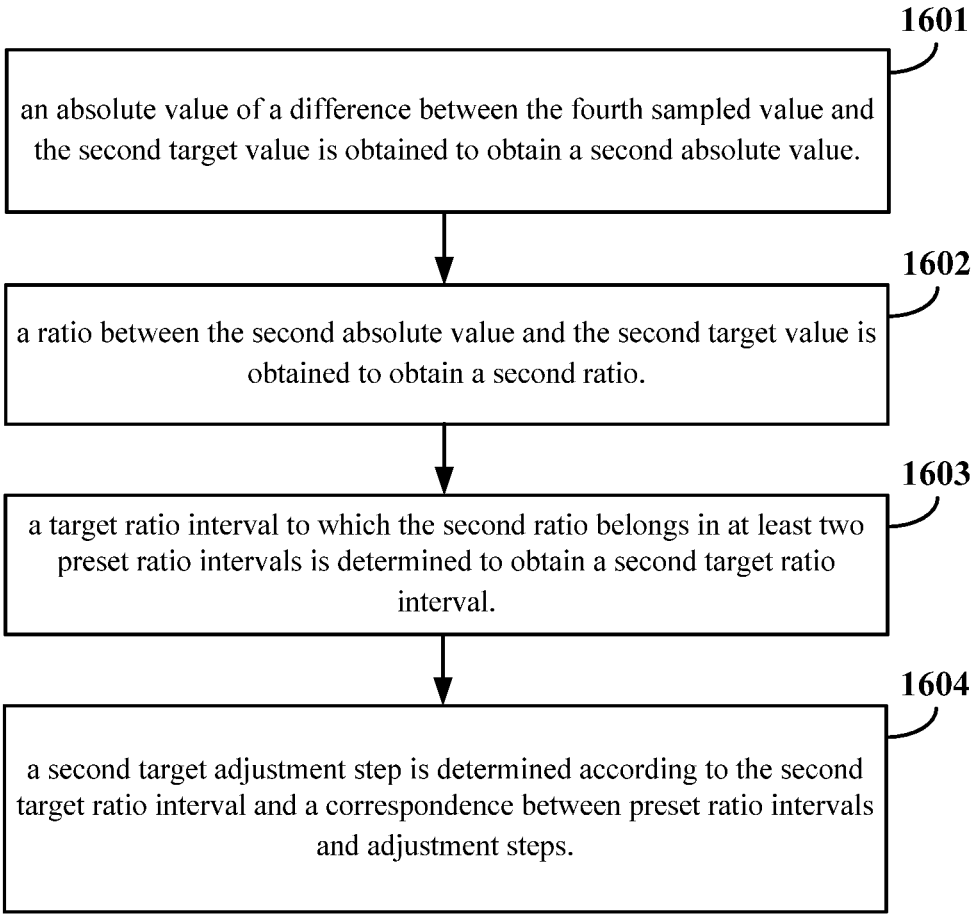
FIG. 16 is a flowchart showing another gamma adjustment method for a display panel according to an embodiment of the present application.

FIG. 16 is a flowchart showing a gamma adjustment method for a display panel according to another embodiment of the present application. In this embodiment, based on the embodiment shown in FIG. 15, the above step 1504 may include the following steps 1601 to 1604.

At step 1601, an absolute value of a difference between the fourth sampled value and the second target value is obtained to obtain a second absolute value.

At step 1602, a ratio between the second absolute value and the second target value is obtained to obtain a second ratio.

At step 1603, a target ratio interval to which the second ratio belongs in at least two preset ratio intervals is determined to obtain a second target ratio interval.

At step 1604, a second target adjustment step is determined according to the second target ratio interval and a correspondence between preset ratio intervals and adjustment steps.

Optionally, when the second target ratio interval is [30%, +∞), then a step value of the second target adjustment step is a first step value; when the second target ratio interval is (5%, 30%], then a step value of the second target adjustment step is a second step value; when the second target ratio interval is [0, 5%), then the step value of the second target adjustment step is a third step value. The first step value is greater than the second value and the second step value is greater than the third step value.

When a ratio in the second target ratio interval is larger, the step value of the corresponding second target adjustment step is larger. Therefore, when the degree of deviation between the fourth sampled value and the second target value is larger, a relatively large adjustment step can be adopted, which is beneficial to shorten the adjustment time. When the ratio in the second target ratio interval is smaller, the step value of the corresponding second target adjustment step is smaller. Therefore, when the degree of deviation between the fourth sampled value and the second target value is smaller, a relatively small adjustment step can be adopted, to avoid a long adjustment duration result from a large adjustment step.

The method for determining the second target adjustment step in this embodiment is similar to the method for determining the first target adjustment step shown in FIG. 12, which is not described herein again.

In this embodiment, by obtaining the second absolute value of the difference between the above fourth sampled value and the above second target value and the second ratio between the above second absolute value and the above second target value, the degree of deviation between the fourth sampled value and the second target value can be determined. Then, the second target ratio interval to which the second ratio belongs in at least two preset ratio intervals can be determined, and the degree of deviation corresponding to each ratio interval is different. And then, the second target adjustment step is determined according to the second target ratio interval and the correspondence between preset ratio intervals and adjustment steps. In this way, a corresponding adjustment step can be determined according to the degree of deviation between the fourth sampled value and the second target value, so that the adjustment step is moderate.

Figure 17:
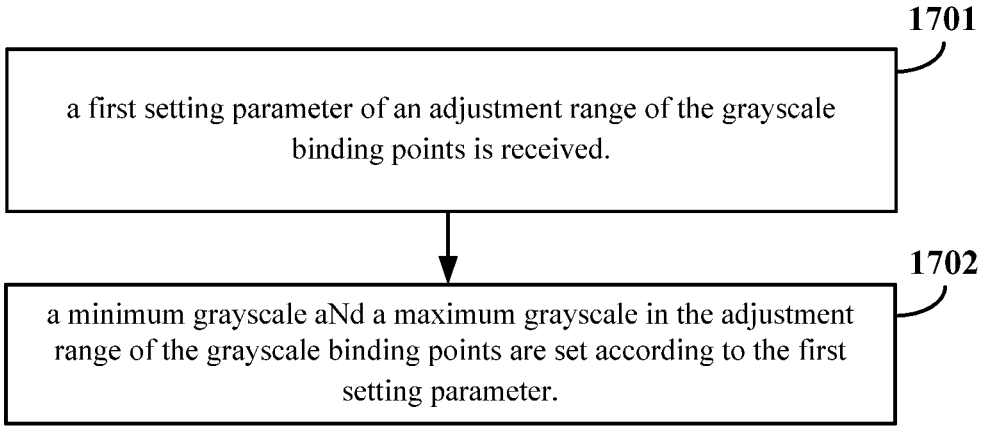
FIG. 17 is a flowchart showing another gamma adjustment method for a display panel according to an embodiment of the present application.

FIG. 17 is a flowchart showing a gamma adjustment method for a display panel according to another embodiment of the present application. In this embodiment, based on the embodiment shown in FIG. 1, before the above step 101, the following steps 1701 to 1702 may be further included.

At step 1701, a first setting parameter of an adjustment range of the grayscale binding points is received.

At step 1702, a minimum grayscale and a maximum grayscale in the adjustment range of the grayscale binding points are set according to the first setting parameter, and the non-low grayscale binding point interval and the low grayscale binding point interval are in the adjustment range of the grayscale binding points.

In this embodiment, the gamma adjustment device can receive the first setting parameter of the adjustment range of the grayscale binding points, and set the minimum grayscale and the maximum grayscale in the adjustment range of the grayscale binding points according to the first setting parameter. The minimum grayscale is a minimum grayscale in the low grayscale binding point interval, and the maximum grayscale is a maximum grayscale in the non-low grayscale binding point interval.

In this embodiment, since the first setting parameter of the adjustment range of the grayscale binding points can be received, and according to the first setting parameter, the minimum grayscale and the maximum grayscale in the adjustment range of the grayscale binding point can be set, the adjustment range of the grayscale binding points can be set independently.

Figure 18:
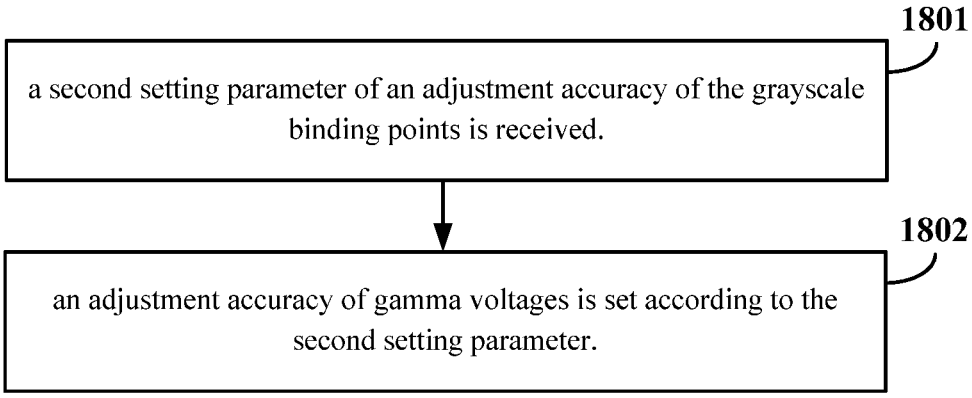
FIG. 18 is a flowchart showing another gamma adjustment method for a display panel according to an embodiment of the present application.

FIG. 18 is a flowchart showing a gamma adjustment method for a display panel according to another embodiment of the present application. In this embodiment, based on the embodiment shown in FIG. 1, before the above step 101, the following steps 1801 to 1802 may be further included.

At step 1801, a second setting parameter of an adjustment accuracy of the grayscale binding points is received.

At step 1802, an adjustment accuracy of gamma voltages is set according to the second setting parameter.

In this embodiment, the gamma adjustment device may receive the second setting parameter of the adjustment accuracy of the grayscale binding points, and set the adjustment accuracy of the gamma voltages according to the second setting parameter.

In this embodiment, since the second setting parameter of the adjustment accuracy of the grayscale binding points can be received, and according to the second setting parameter, the adjustment accuracy of the gamma voltages can be set, the adjustment accuracy of the gamma voltage of the grayscale binding points can be set independently.

Figure 19:
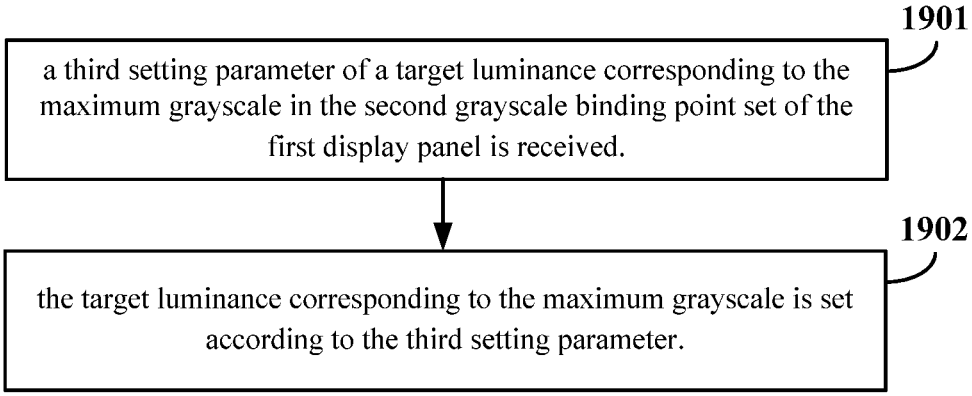
FIG. 19 is a flowchart showing another gamma adjustment method for a display panel according to an embodiment of the present application.

FIG. 19 is a flowchart showing a gamma adjustment method for a display panel according to another embodiment of the present application. In this embodiment, based on the embodiment shown in FIG. 1, before the above step 101, the following steps 1901 to 1902 may further included.

At step 1901, a third setting parameter of a target luminance corresponding to the maximum grayscale in the second grayscale binding point set of the first display panel is received.

At step 1902, the target luminance corresponding to the maximum grayscale is set according to the third setting parameter.

In this embodiment, the gamma adjustment device can receive the third setting parameter of the target luminance corresponding to the maximum grayscale in the second grayscale binding point set of the first display panel and set the target luminance corresponding to the maximum grayscale according to the third setting parameter. Since the third setting parameter of the target luminance corresponding to the maximum grayscale in the second grayscale binding point set of the first display panel in each current display panel group can be received, and the target luminance corresponding to the maximum grayscale can be set according to the third setting parameter, where the target luminance of each of the maximum grayscales corresponds to one display panel group respectively, gamma adjustment for a plurality of display panel groups is enabled.

Optionally, the target luminance corresponding to the maximum grayscale in the second grayscale binding point set of the first display panel in each display panel group is different. Since the target luminance corresponding to the maximum grayscale in the second grayscale binding point set of the first display panel in each display panel group is different, each display panel group can be performed the correspondingly gamma adjustment respectively to improve the efficiency of gamma adjustment.

Figure 20:
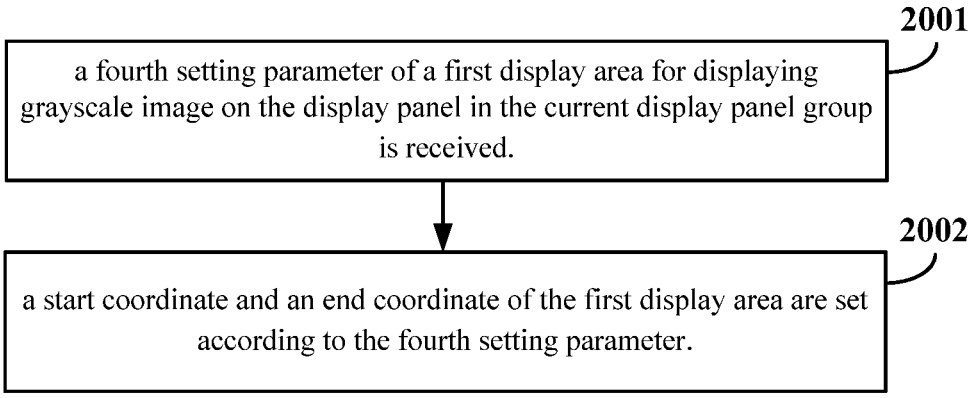
FIG. 20 is a flowchart showing another gamma adjustment method for a display panel according to an embodiment of the present application.

FIG. 20 is a flowchart showing a gamma adjustment method for a display panel according to another embodiment of the present application. In this embodiment, based on the embodiment shown in FIG. 1, before the above step 101, the following steps 2001 to 2002 may be further included.

At step 2001, a fourth setting parameter of a first display area for displaying grayscale image on the display panel in the current display panel group is received.

At step 2002, a start coordinate and an end coordinate of the first display area are set according to the fourth setting parameter.

In this embodiment, the gamma adjustment device may receive the fourth setting parameter of the first display area for displaying the grayscale image on the display panel in the current display panel group, and set the start coordinate and the end coordinate of the first display area according to the fourth setting parameter. Since the fourth setting parameter of the first display area for displaying the grayscale image on the display panel in the current display panel group can be received, and the start coordinate and the end coordinate of the first display area are set according to the fourth setting parameter, a position of the display area for gamma adjustment can be set independently.

Optionally, a second display area corresponding to the full-screen display of the display panel is larger than or equal to the first display area. When the display panel displays in full-screen, the display area is the second display area. Since the second display area may be larger than the first display area or equal to the first display area, the flexibility and the diversity of selecting a size of the display area during gamma adjustment is increased, to adapt to different power consumption requirements. When the second display area corresponding to the full-screen display of the display panel is larger than the first display area, the first display area for displaying grayscale images on the display panel during the process of gamma adjustment is smaller than the second display area corresponding to the full-screen display of the display panel, the power consumption during the process of gamma adjustment can be reduced and the energy can be saved.

In an embodiment, after the above step 101, the following steps may be further included: adjustment information is printed during the process of gamma adjustment, and the adjustment information at least includes the grayscales of the grayscale binding points and the gamma voltages corresponding to the grayscales. Since the adjustment information can be printed during the process of gamma adjustment, the tester can learn about the gamma adjustment in time, so as to find problem in time.

Figure 21:
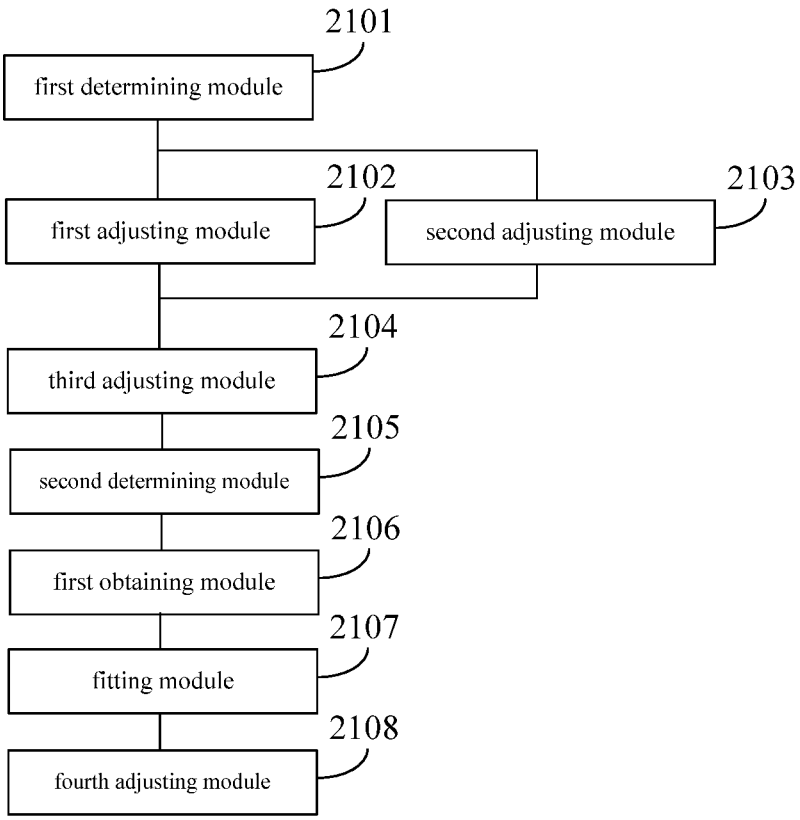
FIG. 21 is a schematic structural diagram showing a gamma adjustment device for a display panel according to an embodiment of the present application.

In an embodiment, a gamma adjustment device for a display panel is provided, as shown in FIG. 21. The gamma adjustment device includes: a first determining module 2101 configured to determine whether a current display panel is a first display panel in a current display panel group; a first adjusting module 2102 configured to, for a first current grayscale binding point in a non-low grayscale binding point interval, adjust a data line input voltage of pixels of the current display panel to a first reference gamma voltage when the current display panel is the first display panel in the current display panel group; a second adjusting module 2103 configured to adjust the data line input voltage of the pixels to a gamma voltage corresponding to a reference grayscale binding point of any display panel that has been gamma adjusted when the current display panel is not the first display panel in the current display panel group, and the grayscale of the reference grayscale binding point is the same as the grayscale corresponding to the first current grayscale binding point; a third adjusting module 2104 configured to adjust the data line input voltage of the pixels according to a comparison result between a sampled value and a first target value of an optical parameter of the pixels, and determine the data line input voltage of the pixels as the gamma voltage when the sampled value of the optical parameter is substantially equal to the first target value; a second determining module 2105 configured to, for a second current grayscale binding point in a low grayscale binding point interval, determine whether an absolute value of a gamma voltage corresponding to the second current grayscale binding point is smaller than an absolute value of a gamma voltage corresponding to a previous grayscale binding point; a first obtaining module 2106 configured to obtain absolute values of gamma voltages corresponding to at least two grayscale binding points located previous to the second current grayscale binding point when it is determined that the absolute value of the gamma voltage corresponding to the second current grayscale binding point is smaller than the absolute value of the gamma voltage corresponding to the previous grayscale binding point, and the grayscale corresponding to the previous grayscale binding point, the grayscales corresponding to the at least two grayscale binding points are respectively larger than the grayscale corresponding to the second current grayscale binding point; a fitting module 2107 configured to obtain a first relationship curve between grayscales and absolute values of gamma voltages by fitting the absolute values of the gamma voltages corresponding to the at least two grayscale binding points; and a fourth adjusting module 2108 configured to adjust the gamma voltage of the second current grayscale according to the grayscale corresponding to the second current grayscale binding point and the first relationship curve, to make the absolute value of the adjusted gamma voltage of the second current grayscale binding point be located on the first relationship curve.

The above-mentioned gamma adjustment device for the display panel can make the data line input voltage of the first current grayscale binding point of the current display panel quickly approach the gamma voltage corresponding to the first current grayscale binding point, which may shorten the time of gamma adjustment and improve the efficiency of gamma adjustment.

Furthermore, since the data line input voltage of the pixels is adjusted according to the comparison result between the sampled value and the first target value of the optical parameter of the pixels, the gamma adjustment may be more targeted, which may be beneficial to shorten the duration of gamma adjustment and improve the efficiency of gamma adjustment.

In addition, by determining whether the gamma voltage is reversed and correcting during the gamma adjustment process, the problem of low grayscale black band, bright band or color shift caused by gamma voltage reversal can be avoided.

In an embodiment, a display device including a display panel and a gamma adjustment device for a display panel shown in FIG. 21 is further provided.

The above-mentioned gamma adjustment device for the display panel can make the data line input voltage of the first current grayscale binding point of the current display panel quickly approach the gamma voltage corresponding to the first current grayscale binding point, which may shorten the time of gamma adjustment and improve the efficiency of gamma adjustment.

Furthermore, since the data line input voltage of the pixels is adjusted according to the comparison result between the sampled value and the first target value of the optical parameter of the pixels, the gamma adjustment may be more targeted, which may be beneficial to shorten the time of gamma adjustment and improve the efficiency of gamma adjustment.

In addition, by determining whether the gamma voltage is reversed and correcting in case of reversal during the gamma adjustment process, the problem of low grayscale black band, bright band or color shift caused by gamma voltage reversal can be avoided.

Figure 22:
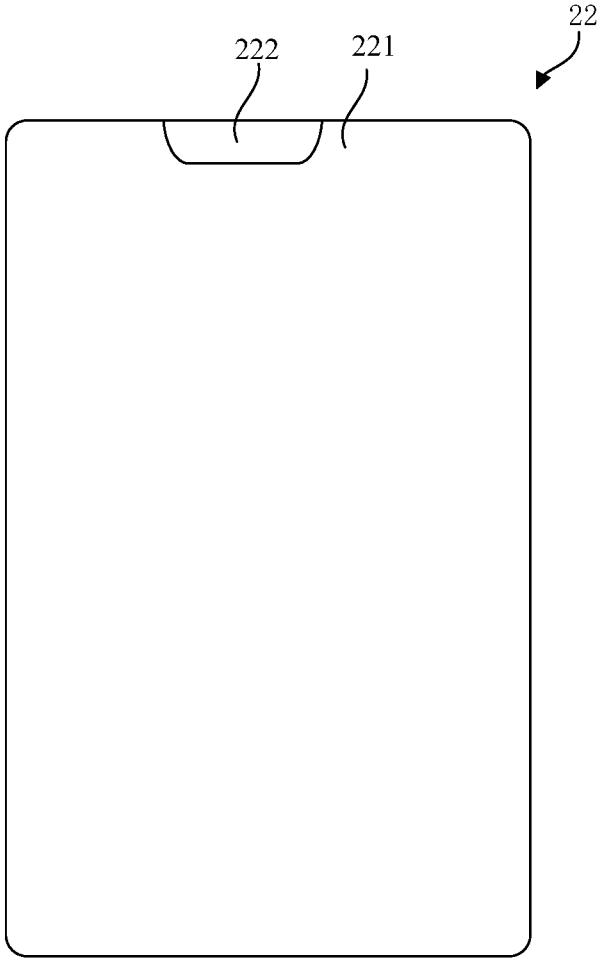
FIG. 22 is a top view for a display panel according to an embodiment of the present application.

Furthermore, in an embodiment, a gamma adjustment method for a display panel, a gamma adjustment device for a display panel and a display device are further provided. The display panel is full-screen. As shown in FIG. 22, the display panel 22 may include a non-transparent display area 221 and a transparent display area 222. The transparent display area 222 is a double-sided light-emitting display area, the front of the transparent display area 222 is the side facing the ambient light and the back of the transparent display area 222 is the side facing away from the ambient light. Generally, an area of the transparent display area is smaller than an area of the non-transparent display area.

Figure 23:
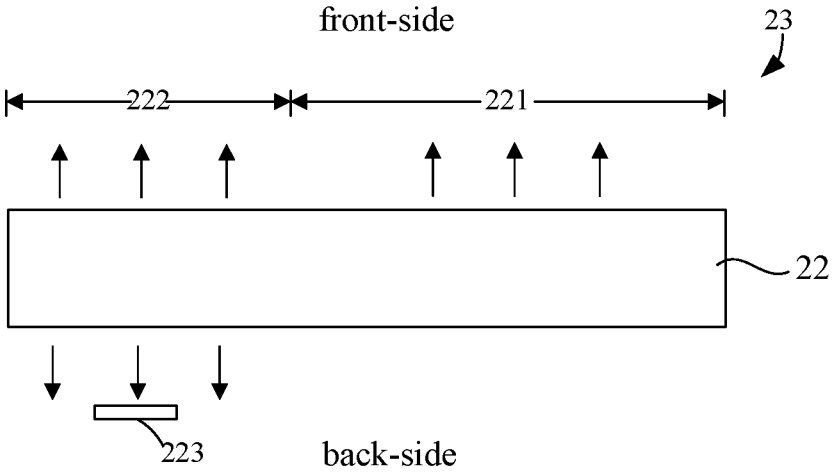
FIG. 23 is a schematic diagram showing the light emission of a transparent display area and a non-transparent display area according to an embodiment of the present application.

As shown in FIGS. 22 and 23, in an embodiment, a display panel (that is, the transparent display area 222) is also provided above a photosensitive element 223 such as a camera and/or a distance sensor of the display device 23. With the transparent display area 222, the area above the photosensitive element 223 of the display device 23 can also normally display an image together with the non-transparent display area 221, and when the photosensitive element 223 is working, the transparent display area 222 may normally transmits light instead of displaying an image, to ensure the photosensitive function. For the transparent display area and the non-transparent display area of the display panel shown in FIG. 22 and FIG. 23, the gamma adjustment method disclosed in the above embodiments can be used for adjusting during the process of gamma adjustment before leaving the factory. Optionally, before leaving the factory, gamma adjustment is performed to the transparent display area and the non-transparent display area, respectively, so that initial luminance, chromaticity and the like of the two display areas after leaving the factory are substantially the same.

For the display panel in the embodiment, since the transparent display area 222 is a double-sided light-emitting display area, and the non-transparent display area 221 is a single-sided light-emitting display area, decay rates of light-emitting materials in the two areas are different, that is, after the display panel works for a period of time, the light-emitting luminance of the transparent display area 222 is gradually lower than the light-emitting luminance of the non-transparent display area 221. As a result, the display luminance of the two areas is non-uniform. Therefore, the luminance of the transparent display area 222 needs to be adjusted to ensure the display effect of the full-screen.

Figure 24:
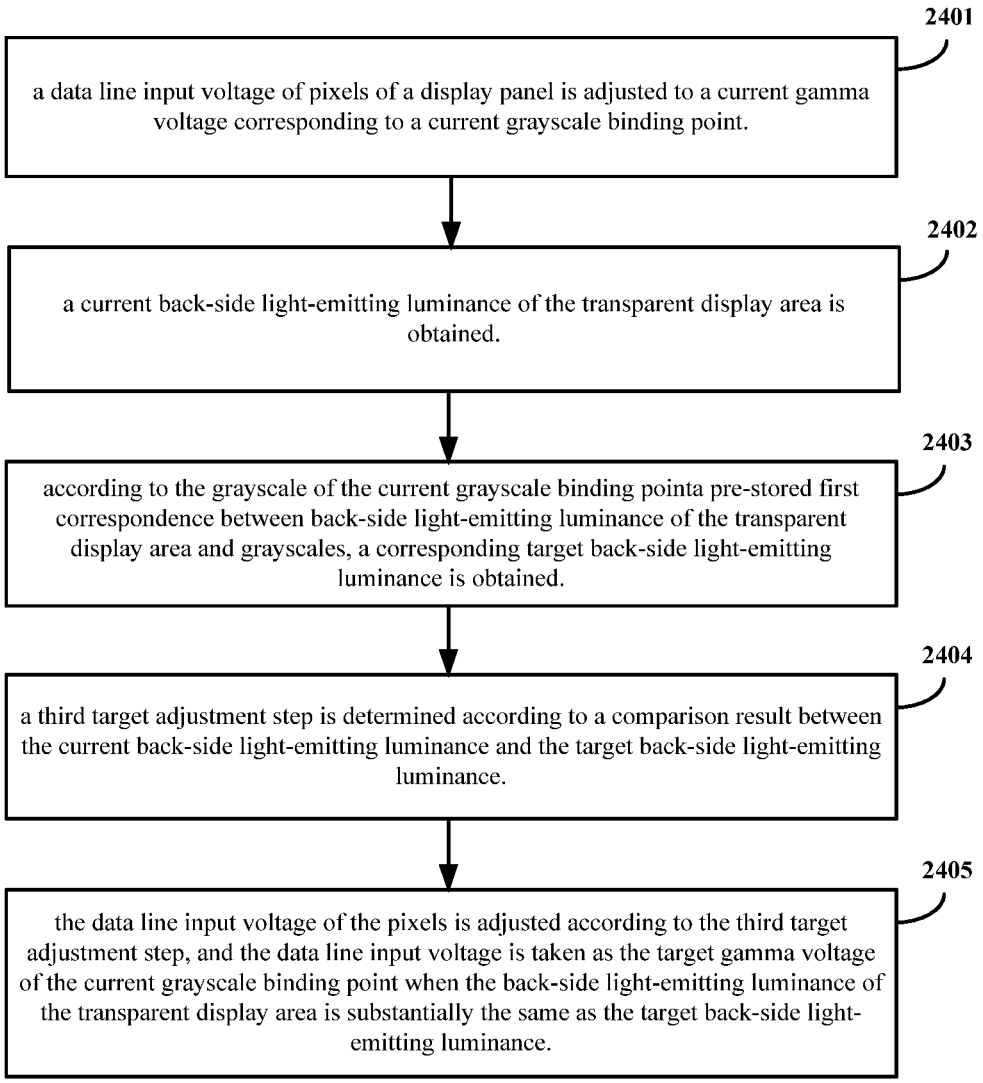
FIG. 24 is a flowchart showing another gamma adjustment method for a display panel according to an embodiment of the present application.

Embodiments of the present application provide a gamma adjustment method for a display panel, which is applied to the gamma adjustment device described below, or is applicable to a display device including a display panel, i.e. the display device described below, in which a program for gamma adjustment is installed. As shown in FIG. 24, the gamma adjustment method includes the following steps 2401 to 2405. In an embodiment, applying the gamma adjustment method for the display panel to the display device is taken as an example for description.

At step 2401, a data line input voltage of pixels of a display panel is adjusted to a current gamma voltage corresponding to a current grayscale binding point.

The gamma register of the display panel pre-stores a group of gamma voltage data of the transparent display area 222 before leaving the factory, and the group of gamma voltage data includes the gamma voltage corresponding to each of the 0-255 grayscales. In this embodiment, the group of gamma voltage data of the transparent display area 222 being stored in the form of a first curve is taken as an example for description. Each point on the first curve corresponds to a gamma voltage of a grayscale, or an absolute value of the gamma voltage of the grayscale.

In an embodiment, the gamma register of the display panel may also pre-store a group of gamma voltage data of the non-transparent display area 221 before leaving the factory, and the group of gamma voltage data includes the gamma voltage corresponding to each of the 0-255 grayscales. In an embodiment, the group of gamma voltage data of the non-transparent display area 221 can be stored in the form of a second curve. Each point on the second curve corresponds to a gamma voltage of a grayscale, or an absolute value of the gamma voltage of the grayscale.

In an embodiment, the display device may perform gamma adjustment on the transparent display area 222 according to a preset time period, and may also perform the gamma adjustment upon receiving a control instruction to start the gamma adjustment. The control instruction can be generated according to an input operation by a user.

When performing the gamma adjustment on the transparent display area 222, a grayscale binding point can be selected from a third grayscale binding point set of the transparent display area 222 as the current grayscale binding point, and according to the grayscale of the current grayscale binding point and the first curve, the current gamma voltage of the current grayscale binding point in the current state can be determined, and then the data line input voltage of the pixels in the transparent display area can be adjusted to the current gamma voltage of the current grayscale binding point, to drive the pixel to emit light.

At step 2402, a current back-side light-emitting luminance of the transparent display area is obtained.

In this embodiment, the current back-side light-emitting luminance of the transparent display area can be obtained through the photosensitive element 223 located under the display panel of the transparent display area. The photosensitive element 223 may be a camera.

At step 2403, according to the grayscale of the current grayscale binding points pre-stored first correspondence between back-side light-emitting luminance of the transparent display area and grayscales, a corresponding target back-side light-emitting luminance is obtained. For the current grayscale binding point, when the back-side light-emitting luminance of the transparent display area is the target back-side light-emitting luminance, a front-side light-emitting luminance of the transparent display area is substantially the same as a light-emitting luminance of the non-transparent display area.

In this embodiment, the gamma register of the display panel may pre-store the first correspondence between back-side light-emitting luminance of the transparent display area and grayscales, and the display device may obtain the corresponding target back-side light-emitting luminance according to the grayscale of the current grayscale binding point and the first correspondence. For a same current grayscale binding point, when the back-side light-emitting luminance of the transparent display area is the target back-side light-emitting luminance, the front-side light-emitting luminance of the transparent display area is substantially the same as a light-emitting luminance of the non-transparent display area.

At step 2404, a third target adjustment step is determined according to a comparison result between the current back-side light-emitting luminance and the target back-side light-emitting luminance.

In this embodiment, the display device can determine the third target adjustment step by comparing the current back-side light-emitting luminance and the target back-side light-emitting luminance. In this way, an appropriate adjustment step can be determined, and a long adjustment duration caused by an improper adjustment step can be avoided.

At step 2405, the data line input voltage of the pixels is adjusted according to the third target adjustment step, and the data line input voltage is taken as the target gamma voltage of the current grayscale binding point when the back-side light-emitting luminance of the transparent display area is substantially the same as the target back-side light-emitting luminance.

In this embodiment, the data line input voltage of the pixels can be adjusted by the display device according to the third target adjustment step, so that the back-side light-emitting luminance of the transparent display area gradually approaches the target back-side light-emitting luminance, and the data line input voltage is taken as the target gamma voltage when the back-side light-emitting luminance of the transparent display area is substantially the same as the target back-side light-emitting luminance.

After the display panel leaves the factory, the data line input voltage of the pixels of the display panel can be adjusted to the current gamma voltage of the current grayscale binding point, and the current back-side light-emitting luminance of the transparent display area can be obtained. Then, according to the grayscale of the current grayscale binding point and the pre-stored first correspondence between back-side light-emitting luminance of the transparent display area and grayscales, the target back-side light-emitting luminance corresponding to the grayscale can be obtained. For the same grayscale binding point, when the back-side light-emitting luminance of the transparent display area is the target back-side light-emitting luminance, the front-side light-emitting luminance of the transparent display area is substantially the same as the light-emitting luminance of the non-transparent display area. Then, the third target adjustment step can be determined according to a comparison result between the current back-side light-emitting luminance and the target back-side light-emitting luminance, and the data line input voltage of the pixel is adjusted according to the third target adjustment step, and the data line input voltage is taken as the target gamma voltage when the back-side light-emitting luminance of the transparent display area is substantially the same as the target back-side light-emitting luminance Thus, after the gamma voltage of the transparent display area is corrected, the front-side light-emitting luminance of the transparent display area can be substantially the same as the light-emitting luminance of the non-transparent display area. The embodiments of the present application can reduce or eliminate the difference in luminance between the transparent display area and the non-transparent display area under the premise that the photosensitive element below the transparent display area can receive a sufficient amount of light, thereby improving the display effect.

Figure 25:
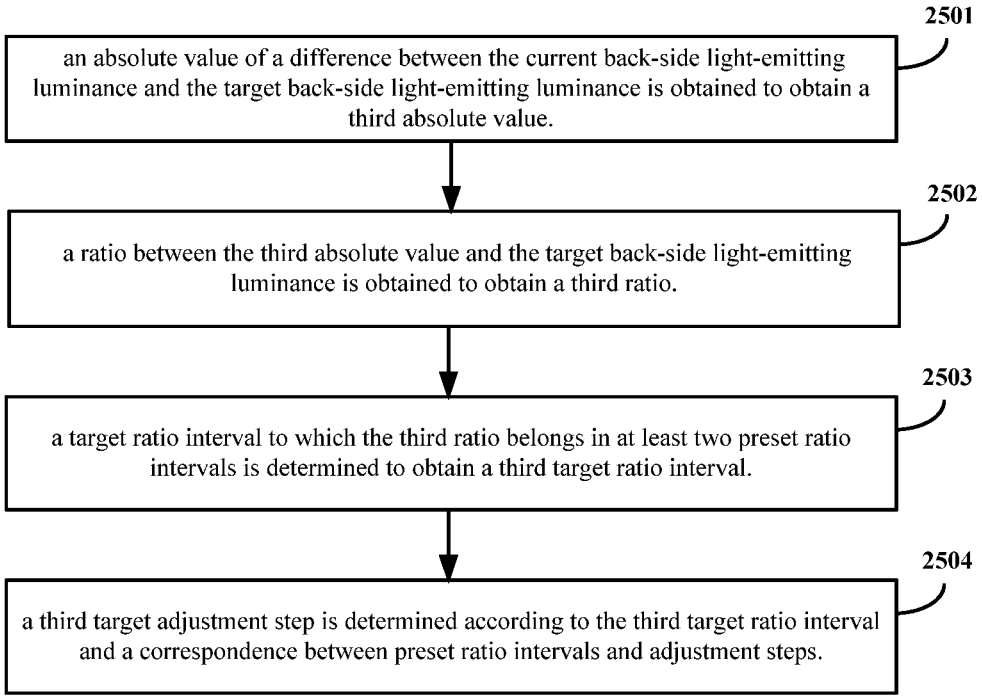
FIG. 25 is a flowchart showing another gamma adjustment method for a display panel according to an embodiment of the present application.

FIG. 25 is a flowchart showing a gamma adjustment method for a display panel according to another embodiment of the present application. In this embodiment, based on the embodiment shown in FIG. 24, the above step 2404 may include the following steps 2501 to 2502.

At step 2501, an absolute value of a difference between the current back-side light-emitting luminance and the target back-side light-emitting luminance is obtained to obtain a third absolute value.

At step 2502, a ratio between the third absolute value and the target back-side light-emitting luminance is obtained to obtain a third ratio.

At step 2503, a target ratio interval to which the third ratio belongs in at least two preset ratio intervals is determined to obtain a third target ratio interval.

At step 2504, a third target adjustment step is determined according to the third target ratio interval and a correspondence between preset ratio intervals and adjustment steps.

In this embodiment, the third absolute value of the difference between the current back-side light-emitting luminance and the target back-side light-emitting luminance can be obtained by the display device, the third ratio between the third absolute value and the target back-side light-emitting luminance can be obtained, the third target ratio interval to which the third ratio belongs can be determined, and then, the third target adjustment step can be determined according to the third target ratio interval and the correspondence between preset ratio intervals and adjustment steps.

The method for determining the third target adjustment step in this embodiment is similar to the method for determining the first target adjustment step shown in FIG. 12, which is not described herein again.

In this embodiment, by obtaining the above third absolute value of the difference between the current back-side light-emitting luminance and the target back-side light-emitting luminance and the above third ratio between the third absolute value and the above target back-side light-emitting luminance, the degree of deviation between the current back-side light-emitting luminance and the target back-side light-emitting luminance can be determined. Then, the third target ratio interval to which the third ratio belongs in at least two preset ratio intervals can be determined, and the degree of deviation corresponding to each ratio interval is different. And then, the third target adjustment step can be determined according to the third target ratio interval and the correspondence between preset ratio intervals and adjustment steps. In this way, a corresponding adjustment step can be determined according to the degree of deviation between the current back-side light-emitting luminance and the target back-side light-emitting luminance, so that the adjustment step is moderate.

Optionally, when the third target ratio interval is [30%, +∞), the step value of the third target adjustment step is the first step value; when the third target ratio interval is (5%, 30%], the step value of the third target adjustment step is the second step value; when the third target ratio interval is [0, 5%), the step value of the third target adjustment step is the third step value. The first step value is greater than the second step value and the second step value is greater than the third step value.

When the ratio in the third target ratio interval is larger, the step value of the corresponding third target adjustment step is larger. Therefore, when the degree of deviation between the current back-side light-emitting luminance and the target back-side light-emitting luminance is larger, a relatively large adjustment step can be adopted, which is beneficial to shorten the adjustment time. When the ratio in the third target ratio interval is smaller, the step value of the corresponding third target adjustment step is smaller. Therefore, when the degree of deviation between the current back-side light-emitting luminance and the target back-side light-emitting luminance is smaller, a relatively small adjustment step can be adopted, to avoid a long adjustment time period result from a large adjustment step.

After the display panel leaves the factory, in order to reduce the complexity of gamma adjustment and improve the efficiency of gamma adjustment in the display terminal after leaving the factory, as well as based on the low sensitivity of human eyes to low grayscale images (e.g., luminance less than 10 nits), adapting the gamma adjustment method shown in FIG. 24 or FIG. 25 to perform the gamma adjustment on the high grayscale binding points and the middle grayscale binding points can meet most of the requirements in practical applications. Further, in order to improve the display effect of the low grayscale image, the gamma adjustment method shown in FIG. 26 can be performed to perform the gamma adjustment on the low grayscale binding points, as follows.

Figure 26:
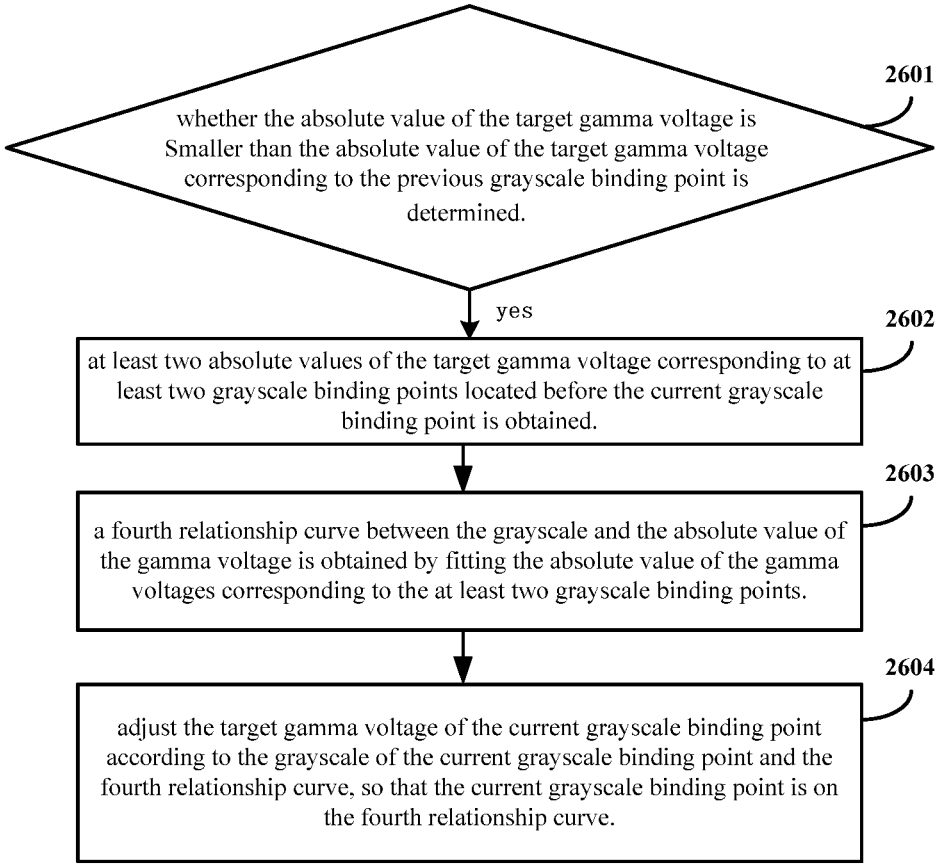
FIG. 26 is a flowchart showing another gamma adjustment method for a display panel according to an embodiment of the present application.

FIG. 26 is a flowchart showing a gamma adjustment method for a display panel according to another embodiment of the present application. In this embodiment, when the current grayscale binding point is located in the low grayscale binding point interval, based on the embodiment shown in FIG. 24, after the above step 2405, the following steps 2601 to 2604 may be further included.

At step 2601, whether the absolute value of the target gamma voltage is smaller than an absolute value of a target gamma voltage corresponding to a previous grayscale binding point is determined. When the absolute value of the target gamma voltage is less than the absolute value of the gamma voltage corresponding to the previous grayscale binding point, step 2602 is performed.

At step 2602, absolute values of target gamma voltages corresponding to at least two grayscale binding points located previous to the current grayscale binding point are obtained. The grayscale corresponding to the previous grayscale binding point, the grayscales corresponding to the at least two grayscale binding points are respectively larger than the grayscale of the current grayscale binding point.

At step 2603, a fourth relationship curve between grayscales and absolute values of gamma voltages is obtained by fitting the absolute values of the target gamma voltages corresponding to the at least two grayscale binding points.

At step 2604, the target gamma voltage of the current grayscale binding point is adjusted according to the grayscale of the current grayscale binding point and the fourth relationship curve, so that the absolute value of the adjusted target gamma voltage of current grayscale binding point is on the fourth relationship curve.

The steps 2601-2609 in this embodiment is similar to the steps 106-109 in the embodiment shown in FIG. 1, which is not described herein again.

In the embodiment, for the current grayscale binding point in the low grayscale binding point interval, when it is determined that the absolute value of the target gamma voltage corresponding to the current grayscale binding point is smaller than the absolute value of the target gamma voltage corresponding to the previous grayscale binding point, the absolute values of the target gamma voltages corresponding to the at least two grayscale binding points located previous to the current grayscale binding point can be obtained, and the fourth relationship curve between grayscales and absolute values of gamma voltages can be obtained by fitting the absolute values of the target gamma voltages corresponding to the at least two grayscale binding points, and then the target gamma voltage of the current grayscale binding point is adjusted according to the grayscale of the current grayscale binding point and the fourth relationship curve, to make the absolute value of the adjusted target gamma voltage of the current grayscale binding point be located on the fourth relationship curve. Since the gamma voltages of all grayscale binding points of the same display panel have the same variation trend according to the same arrangement direction of the grayscale binding points, the current grayscale binding point should actually be located on the fourth relationship curve or close to the fourth relationship curve. Therefore, the absolute value of the target gamma voltage corresponding to the grayscale of the current grayscale binding point on the fourth relationship curve should be the absolute value of the actual gamma voltage corresponding to the grayscale of the current grayscale binding point, or close to the absolute value of the actual gamma voltage corresponding to the grayscale of the current grayscale binding point. Therefore, the absolute value of the adjusted target gamma voltage of the current grayscale binding point on the fourth relationship curve is closer to the absolute value of the actual gamma voltage corresponding to the grayscale of the current grayscale binding point. In this way, by determining whether the gamma voltage is reversed and correcting in the case of reversal during the gamma adjustment process, the problem of low grayscale black band, bright band or color shift caused by gamma voltage reversal can be avoided.

Figure 27:
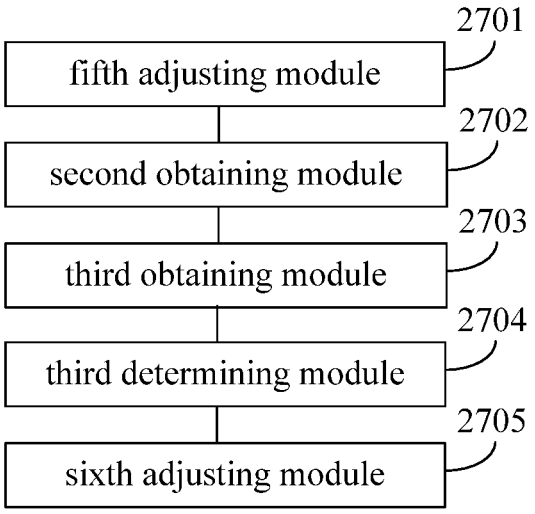
FIG. 27 is a schematic structural diagram showing a gamma adjustment device for a display panel according to an embodiment of the present application.

The embodiment also provides a gamma adjustment device for a display panel, which adjusts the display panel after leaving the factory. The display panel includes a non-transparent display area and a transparent display area. The transparent display area is a double-sided light-emitting display area, and the front of the transparent display area is the side facing the ambient light and the back of the transparent display area is the side facing away from the ambient light. As shown in FIG. 27, the gamma adjustment device includes: a fifth adjusting module 2701 configured to adjust the data line input voltage of the pixels of the display panel to the current gamma voltage of the current grayscale binding point; a second obtaining module 2702 configured to obtain the current back-side light-emitting luminance of the transparent display area; a third obtaining module 2703 configured to obtain the corresponding target back-side light-emitting luminance according to the grayscale of the current grayscale binding point and the pre-stored first correspondence between back-side light-emitting luminance of the transparent display area and grayscales, where for the current grayscale binding point, when the back-side light-emitting luminance of the transparent display area is the target back-side light-emitting luminance, the front-side light-emitting luminance of the transparent display area is substantially the same as the light-emitting luminance of the non-transparent display area; a third determining module 2704 configured to determine a third target adjustment step according to a comparison result between the current back-side light-emitting luminance and the target back-side light-emitting luminance; and a sixth adjusting module 2705 configured to adjust the data line input voltage of the pixels according to the third target adjustment step, and the data line input voltage is taken as the target gamma voltage when the back-side light-emitting luminance of the transparent display area is substantially the same as the target back-side light-emitting luminance.

Figure 28:
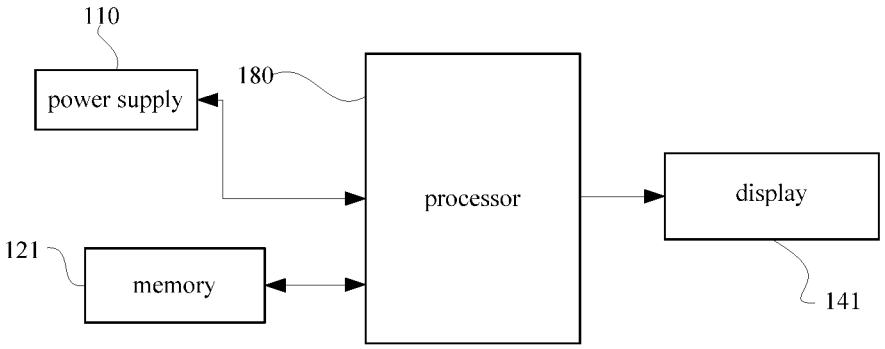
FIG. 28 is a schematic structural diagram showing another gamma adjustment device for a display panel according to an embodiment of the present application.

In an embodiment, the gamma adjustment device for the display panel includes a display 141, one or more processors 180, a memory 121, and a power supply 110, as shown in FIG. 28. The memory 121 is configured to store computer program code, and the computer program code includes computer instructions. The processor 180 is connected to the display 141 and the memory 121. The processor 180 is configured to cause the gamma adjustment device to perform the gamma adjustment method for the display panel as described above when the processor executes the computer instructions. The display 141 displays gamma adjustment information generated by the processor 180. The power supply 110 is configured to supply power to various modules of the gamma adjustment device for the display panel.

The above gamma adjustment device for display panel can reduce or eliminate the difference between luminance of the transparent display area and the non-transparent display area under the premise that the photosensitive element below the transparent display area can receive a sufficient amount of light, thereby improving the display effect.

In an embodiment, a display device including a display panel and a gamma adjustment device for display panel shown in FIG. 27 is also provided.

In this embodiment, as shown in FIG. 23, the display panel of the display device 23 may be the display panel 22 shown in FIG. 22, and the photosensitive element 223 is provided on the back of (or below) the transparent display area 222. The photosensitive element 223 may be a camera, a photosensitive element, etc., and the number of the photosensitive element 223 may be one or more. The gamma adjustment device is the gamma adjustment device for display panel shown in FIG. 27.

By the above gamma adjustment device for the display panel, under the premise that the photosensitive element below the transparent display area can receive a sufficient amount of light, the difference between luminance of the transparent display area and the non-transparent display area can be reduced or eliminated, thereby improving the display effect.

In an embodiment, the display device may be any product or component with a display function, such as electronic paper, mobile phone, tablet computer, television, notebook computer, digital photo frame, and navigator.

An embodiment of the present application also provides a computer storage medium including computer instructions. When the computer instructions are executed on the computer, the computer is caused to perform the gamma adjustment method for display panel described above.

Other embodiments of the present application will be readily conceivable to a person skilled in the art upon consideration of the description and practice of the disclosure disclosed herein. The present application is intended to cover any variation, use or adaptive variation of the present application, and these variations, uses or adaptive variations follow the general principles of the present application and include common general knowledge or customary technical means in the technical field not disclosed in the present application. The description and examples are considered to be exemplary only, and the true scope and spirit of the present application are indicated by the following claims.

The invention claimed is:

1. A gamma adjustment method for a display panel, comprising:

determining whether a current display panel is a first display panel in a current display panel group; in response to determining that the current display panel is the first display panel in the current display panel group, for a first current grayscale binding point in a non-low grayscale binding point interval, adjusting a data line input voltage of pixels of the current display panel to a first reference gamma voltage; and in response to determining that the current display panel is not the first display panel in the current display panel group, adjusting the data line input voltage of the pixels to a gamma voltage corresponding to a reference grayscale binding point of any one of the display panels that have been gamma adjusted, wherein a grayscale of the reference grayscale binding point is the same as a grayscale of the first current grayscale binding point;

adjusting the data line input voltage of the pixels according to a comparison result between a sampled value and a first target value of an optical parameter of the pixels, and taking the data line input voltage of the pixels when the sampled value of the optical parameter is substantially equal to the first target value as a gamma voltage corresponding to the first current grayscale binding point;

for a second current grayscale binding point in a low grayscale binding point interval, determining whether an absolute value of a gamma voltage corresponding to the second current grayscale binding point is smaller than an absolute value of a gamma voltage corresponding to a previous grayscale binding point; in response to determining that the absolute value of the gamma voltage corresponding to the second current grayscale binding point is smaller than the absolute value of the gamma voltage corresponding to the previous grayscale binding point, obtaining absolute values of gamma voltages corresponding to at least two grayscale binding points located previous to the second current grayscale binding point; wherein the grayscale corresponding to the previous grayscale binding point and the respective grayscales corresponding to the at least two grayscale binding points are larger than the grayscale of the second current grayscale binding point;

obtaining a first relationship curve between grayscales and absolute values of gamma voltages by fitting the respective grayscales corresponding to the at least two grayscale binding points and the absolute values of the gamma voltages corresponding to the at least two grayscale binding points; and adjusting the gamma voltage corresponding to the second current grayscale binding point according to the grayscale corresponding to the second current grayscale binding point and the first relationship curve, in a way that the absolute value of the adjusted gamma voltage corresponding to the second current grayscale binding point is located on the first relationship curve.

2. The gamma adjustment method for a display panel according to claim 1, wherein the at least two grayscale binding points are sequentially adjacent to the second current grayscale binding point, the method further comprises:

obtaining the first relationship curve between grayscales and absolute values of gamma voltages by fitting the grayscales corresponding to the at least two grayscale binding points and the absolute values of the gamma voltages corresponding to the at least two grayscale binding points comprises:

obtaining a first linear equation indicating a correspondence between absolute values of gamma voltages and grayscales by calculation from the grayscales and the absolute values of the gamma voltages corresponding to the at least two grayscale binding points; and taking the first liner equation as the first relationship curve.

3. The gamma adjustment method for a display panel according to claim 1, wherein after determining whether the absolute value of the gamma voltage corresponding to the second current grayscale binding point is smaller than the absolute value of the gamma voltage corresponding to the previous grayscale binding point, the method further comprises:

in response to determining that the absolute value of the gamma voltage corresponding to the second current grayscale binding point is smaller than the absolute value of the gamma voltage corresponding to the previous grayscale binding point, selecting a preset number of grayscales adjacent to the second current grayscale binding point as additional grayscale binding points; and adding the additional grayscale binding points to a first grayscale binding point set of the current display panel.

4. The gamma adjustment method for a display panel according to claim 3, wherein the additional grayscale binding points include at least one first grayscale binding point with a grayscale smaller than the grayscale of the second current grayscale binding point; and/or the additional grayscale binding points include at least one second grayscale binding point with a grayscale larger than the grayscale of the second current grayscale binding point, and the grayscale of the at least one second grayscale binding point is smaller than the grayscale of the previous grayscale binding point.

5. The gamma adjustment method for a display panel according to claim 3, wherein after adding the additional grayscale binding points to the first grayscale binding point set of the current display panel, the method further comprises:

determining the preset number of grayscale binding points that have not been adjusted from the first grayscale binding point set as grayscale binding points to be removed, where the grayscale binding points to be removed and the additional grayscale binding points are different;

removing the grayscale binding points to be removed from the first grayscale binding point set.

6. The gamma adjustment method for a display panel according to claim 1, wherein before determining whether the absolute value of the gamma voltage corresponding to the second current grayscale binding point is smaller than the absolute value of the gamma voltage corresponding to the previous grayscale binding point, the method further comprises:

determining whether a voltage adjustment parameter of the second current grayscale binding point in the low grayscale binding point interval meets a first preset condition; in response to determining the voltage adjustment parameter of the second current grayscale binding point in the low grayscale binding point interval meets the first preset condition, taking a current data line input voltage of the pixels as the gamma voltage corresponding to the second current grayscale binding point, or outputting a prompt information for prompting adjustment abnormality; wherein the voltage adjustment parameter is a number of voltage adjustment times, and the first preset condition is that the number of voltage adjustment times is greater than a preset number of times; or the voltage adjustment parameter is a duration of voltage adjustment, and the first preset condition is that the duration of voltage adjustment is longer than a preset duration;

the pixels are pixels of any color in pixel units comprised in the display panel, each of the pixel units of the display panel comprises a plurality of pixels of N colors, where N is a positive integer; and the gamma voltage corresponding to the second current grayscale binding point comprises gamma voltages corresponding to the pixels of N colors respectively.

7. The gamma adjustment method for a display panel according to claim 1, wherein for the first current grayscale binding point in the non-low grayscale binding point interval, adjusting the data line input voltage of the pixels of the current display panel to the first reference gamma voltage comprises:

adjusting the data line input voltage of the pixels to obtain at least two sets of data, wherein the sampled value of the optical parameter of the pixels changes as the data line input voltage of the pixels changes; and the at least two sets of data comprises absolute values of at least two data line input voltages and sampled values of the optical parameter corresponding to the at least two data line input voltages;

obtaining a second relationship curve between absolute values of data line input voltages and sampled values of the optical parameter by fitting the at least two sets of data;

obtaining a target data line input voltage corresponding to the first target value according to the first target value of the optical parameter corresponding to the first current grayscale binding point and the second relationship curve; and determining the first reference gamma voltage according to the target data line input voltage, and adjusting the data line input voltage of the pixel to the first reference gamma voltage, wherein the optical parameter comprises a color coordinate, and/or the optical parameter comprises luminance; the pixels are pixels of any color in pixel units comprised in the display panel, each of the pixel units of the display panel comprises a plurality of pixels of N colors, where N is a positive integer; and a sampled value of the luminance corresponding to the data line input voltage of the pixels is a sampled value of the luminance of the pixel units.

8. The gamma adjustment method for a display panel according to claim 7, wherein the at least two sets of data comprises two sets of data, the two sets of data comprises absolute values of two data line input voltages and sampled values of the optical parameter corresponding to the two data line input voltages; and the absolute values of the two data line input voltages are both greater than an absolute value of the target data line input voltage; and obtaining the second relationship curve between absolute values of data line input voltages and sampled values of the optical parameter by fitting the at least two sets of data comprises:

obtaining a second linear equation indicating a correspondence between sampled values of the optical parameter and input voltages corresponding to the first current grayscale binding point by calculation from the absolute values of the two data line input voltages and the sampled values of the optical parameter corresponding to the two data line input voltages; and taking the second liner equation as the second relationship curve.

9. The gamma adjustment method for a display panel according to claim 1, wherein determining whether the current display panel is the first display panel in the current display panel group comprises:

obtaining a pre-stored reference data line input voltage;

obtaining a first sampled value of the optical parameter of the pixels when the data line input voltage of the pixels is the reference data line input voltage;

determining whether an absolute value of a difference between the first sampled value and the first target value is larger than a preset threshold; in response to determining that the difference between the first sampled value and the first target value is larger than the preset threshold, determining the current display panel is the first display panel in the current display panel group;

and in response to determining that the difference between the first sampled value and the first target value is less than or equal to the preset threshold, determining the current display panel is not the first display panel in the current display panel group, wherein the reference data line input voltage is a default value pre-stored in a gamma voltage register; or the reference data line input voltage is a gamma voltage which is corresponding to a reference grayscale binding point of any one of display panels that have been gamma adjusted and which is pre-stored in a gamma adjustment device, and any one of the display panels that have been gamma adjusted comprises a display panel with a minimum time interval between the gamma adjustment time of the display panel and the current time in the display panels that have been gamma adjusted.

10. The gamma adjustment method for a display panel according to claim 1, wherein adjusting the data line input voltage of the pixels according to the comparison result between the sampled value and the first target value of the optical parameter of the pixels comprises:

obtaining a second sampled value of the optical parameter of the pixels;

determining a first target adjustment step according to a comparison result between the second sampled value and the first target value; and adjusting the data line input voltage of the pixels according to the first target adjustment step, until the sampled value of the optical parameter of the pixels reaches the first target value.

11. The gamma adjustment method for a display panel according to claim 10, wherein determining the first target adjustment step according to the comparison result between the second sampled value and the first target value comprises:

obtaining a first absolute value by obtaining an absolute value of a difference between the second sampled value and the first target value;

obtaining a first ratio by obtaining a ratio between the first absolute value and the first target value;

obtaining a first target ratio interval by determining a target ratio interval to which the first ratio belongs in at least two preset ratio intervals; and determining the first target adjustment step according to the first target ratio interval and a correspondence between preset ratio intervals and adjustment steps, wherein when the first target ratio interval is [30%, +∞), a step value of the first target adjustment step is a first step value; when the first target ratio interval is (5%, 30%], the step value of the first target adjustment step is a second step value; and when the first target ratio interval is [0, 5%), the step value of the first target adjustment step is a third step value, wherein the first step value is greater than the second step value, and the second step value is greater than the third step value.

12. The gamma adjustment method for a display panel according to claim 1, wherein after adjusting the data line input voltage of the pixels according to the comparison result between the sampled value and the first target value of the optical parameter of the pixels, the method further comprises:

determining whether a voltage adjustment parameter of the first current grayscale binding point meets a second preset condition; in response to determining that the voltage adjustment parameter of the first current grayscale binding point meets the second preset condition, determining whether an absolute value of a difference between a third sampled value of the optical parameter of the pixels and the first target value is smaller than a preset threshold; and in response to determining that the absolute value of the difference between the third sampled value of the optical parameter of the pixels and the first target value is smaller than the preset threshold, taking a current data line input voltage of the pixels as the gamma voltage corresponding to the first current grayscale binding point, wherein in response to determining that the voltage adjustment parameter of the first current grayscale binding point meets the second preset condition, outputting a prompt message for prompting an adjustment abnormality;

the voltage adjustment parameter is a number of voltage adjustment times, and the second preset condition is that the number of the voltage adjustment times is greater than a preset number of times; or the voltage adjustment parameter is a duration of voltage adjustment, and the second preset condition is that the duration of voltage adjustment is longer than a preset duration.

13. The gamma adjustment method for a display panel according to claim 1, wherein after adjusting the gamma voltage corresponding to the second current grayscale binding point according to the grayscale corresponding to the second current grayscale binding point and the first relationship curve, in a way that the absolute value of the adjusted gamma voltage of the second current grayscale binding point is located on the first relationship curve, the method further comprises:

after all grayscale binding points in a second grayscale binding point set of the first display panel have been gamma adjusted, obtaining a third relationship curve between grayscales and absolute values of gamma voltages by fitting absolute values of gamma voltages corresponding to all the grayscale binding points in the second grayscale binding point set; and obtaining absolute values of respective gamma voltages corresponding to each of grayscales that have not been gamma adjusted according to the grayscales that have not been gamma adjusted of the first display panel and the third relationship curve.

14. The gamma adjustment method for a display panel according to claim 13, wherein after obtaining the absolute values of the respective gamma voltages corresponding to each of the grayscales that have not been gamma adjusted, the method further comprises:

for each grayscale of the grayscales that have not been gamma adjusted, determining a gamma voltage corresponding to the grayscale according to the absolute value of the gamma voltage corresponding to the grayscale;

adjusting the data line input voltage of the pixels of the first display panel to the gamma voltage corresponding to the grayscale;

obtaining a fourth sampled value of the optical parameter of the pixels;

determining a second target adjustment step according to a comparison result between the fourth sampled value and a second target value of the optical parameter of the pixels; and adjusting the data line input voltage of the pixels according to the second target adjustment step, until the sampled value of the optical parameter of the pixels reaches the second target value.

15. The gamma adjustment method for a display panel according to claim 14, wherein determining the second target adjustment step according to the comparison result between the fourth sampled value and the second target value of the optical parameter of the pixels comprises:

obtaining a second absolute value by obtaining an absolute value of a difference between the fourth sampled value and the second target value;

obtaining a first ratio by obtaining a ratio between the second absolute value and the second target value;

obtaining a second target ratio interval by determining a target ratio interval to which the second ratio belongs in at least two preset ratio intervals; and determining a second target adjustment step according to the second target ratio interval and a correspondence between preset ratio intervals and adjustment steps, wherein when the second target ratio interval is [30%, +∞), the step value of the second target adjustment step is a first step value; when the second target ratio interval is (5%, 30%], the step value of the second target adjustment step is a second step value; and when the second target ratio interval is [0, 5%), the step value of the second target adjustment step-is a third step value, wherein the first step value is greater than the second step value and the second step value is greater than the third step value.

16. The gamma adjustment method for a display panel according to claim 1, wherein before determining whether the current display panel is the first display panel in the current display panel group, the method further comprises at least one of:

receiving a first setting parameter of an adjustment range of the grayscale binding points; and setting a minimum grayscale and a maximum grayscale in the adjustment range of the grayscale binding points according to the first setting parameter, wherein the non-low grayscale binding point interval and the low grayscale binding point interval are in the adjustment range of the grayscale binding points; or receiving a second setting parameter of an adjustment accuracy of the grayscale binding points; and setting an adjustment accuracy of the gamma voltage according to the second setting parameter; or receiving a third setting parameter of a target luminance corresponding to a maximum grayscale in a second grayscale binding point set of the first display panel, and setting the target luminance corresponding to the maximum grayscale according to the third setting parameter, wherein a target luminance corresponding to a maximum grayscale in a second grayscale binding point set of a first display panel in each of display panel groups is different; or receiving a fourth setting parameter of a first display area for displaying a grayscale image on the display panel in the current display panel group, and setting a start coordinate and an end coordinate of the first display area according to the fourth setting parameter, wherein a second display area corresponding to a full-screen display of the display panel is larger than or equal to the first display area; or printing adjustment information during the process of gamma adjustment, wherein the adjustment information at least comprises grayscales corresponding to the grayscale binding points and the gamma voltages corresponding to the grayscale binding points.

17. A gamma adjustment method for a display penal, the method being applicable for adjusting the display panel after leaving the factory, wherein the display panel comprises a non-transparent display area and a transparent display area, the transparent display area is a double-sided light-emitting display area, a front of the transparent display area is a side facing an ambient light and a back of the transparent display area is a side facing away from the ambient light, and the method comprises:

adjusting a data line input voltage of pixels in the transparent display area to a current gamma voltage corresponding to a current grayscale binding point;

obtaining a current back-side light-emitting luminance of the transparent display area;

obtaining a target back-side light-emitting luminance according to a grayscale corresponding to the current grayscale binding point and a pre-stored first correspondence between back-side light-emitting luminance of the transparent display area and grayscales; wherein for the current grayscale binding point, when the back-side light-emitting luminance of the transparent display area is the target back-side light-emitting luminance, a front-side light-emitting luminance of the transparent display area is substantially the same as a light-emitting luminance of the non-transparent display area;

determining a third target adjustment step according to a comparison result between the current back-side light-emitting luminance and the target back-side light-emitting luminance; and adjusting the data line input voltage of the pixels according to the third target adjustment step, and taking the data line input voltage when the back-side light-emitting luminance of the transparent display area is substantially the same as the target back-side light-emitting luminance as the target gamma voltage.

18. The gamma adjustment method for a display panel according to claim 17, wherein determining the third target adjustment step according to the comparison result between the current back-side light-emitting luminance and the target back-side light-emitting luminance comprises:

obtaining a third absolute value by obtaining an absolute value of a difference between the current back-side light-emitting luminance and the target back-side light-emitting luminance;

obtaining a third ratio by obtaining a ratio between the third absolute value and the target back-side light-emitting luminance;

obtaining a third target ratio interval by determining a target ratio interval to which the third ratio belongs in at least two preset ratio intervals; and determining the third target adjustment step according to the third target ratio interval and a correspondence between preset ratio intervals and adjustment steps, wherein when the third target ratio interval is [30%, +∞), the step value of the third target adjustment step is a first step value; when the third target ratio interval is (5%, 30%], the step value of the third target adjustment step is a second step value; and when the third target ratio interval is [0, 5%), the step value of the third target adjustment step is a third step value, wherein the first step value is greater than the second step value and the second step value is greater than the third step value.

19. The gamma adjustment method for a display panel according to claim 17, wherein when the current grayscale binding point is located in a low grayscale binding point interval, after taking the data line input voltage when the back-side light-emitting luminance of the transparent display area is substantially the same as the target back-side light-emitting luminance as the target gamma voltage, the method further comprises:

determining whether an absolute value of the target gamma voltage is smaller than an absolute value of a target gamma voltage corresponding to a previous grayscale binding point;

in response to determining that the absolute value of the target gamma voltage corresponding to the current grayscale binding point is less than the absolute value of the target gamma voltage corresponding to the previous grayscale binding point, obtaining absolute values of target gamma voltages corresponding to at least two grayscale binding points located previous to the current grayscale binding point; wherein each of a grayscale corresponding to the previous grayscale binding point, and grayscales corresponding to the at least two grayscale binding points is larger than the grayscale corresponding to the current grayscale binding point;

obtaining a fourth relationship curve between grayscales and absolute values of gamma voltages by fitting the absolute values of the target gamma voltages corresponding to the at least two grayscale binding points; and adjusting the target gamma voltage corresponding to the current grayscale binding point according to the grayscale corresponding to the current grayscale binding point and the fourth relationship curve, in a way that the absolute value of the adjusted gamma voltage of the current grayscale binding point is on the fourth relationship curve.

20. A gamma adjustment device for a display panel, comprising:

a display;

a memory configured to store computer program codes, and the computer program codes comprise computer instructions; and one or more processors connected to the display and the memory; wherein the one or more processors are configured to perform a gamma adjustment method for the display panel when the one or more processors execute the computer instructions, and gamma adjustment information generated by the one or more processors is displayed on the display, wherein the gamma adjustment method for the display penal comprises:

determining whether a current display panel is a first display panel in a current display panel group; in response to determining that the current display panel is the first display panel in the current display panel group, for a first current grayscale binding point in a non-low grayscale binding point interval, adjusting an data line input voltage of pixels of the current display panel to a first reference gamma voltage; and in response to determining that the current display panel is not the first display panel in the current display panel group, adjusting the data line input voltage of the pixels to a gamma voltage corresponding to a reference grayscale binding point of any one of the display panels that have been gamma adjusted, wherein a grayscale of the reference grayscale binding point is the same as a grayscale of the first current grayscale binding point;

adjusting the data line input voltage of the pixels according to a comparison result between a sampled value and a first target value of an optical parameter of the pixels, and taking the data line input voltage of the pixels when the sampled value of the optical parameter is substantially equal to the first target value as a gamma voltage corresponding to the first current grayscale binding point;

for a second current grayscale binding point in a low grayscale binding point interval, determining whether an absolute value of a gamma voltage corresponding to the second current grayscale binding point is smaller than an absolute value of a gamma voltage corresponding to a previous grayscale binding point; in response to determining that the absolute value of the gamma voltage corresponding to the second current grayscale binding point is smaller than the absolute value of the gamma voltage corresponding to the previous grayscale binding point, obtaining absolute values of gamma voltages corresponding to at least two grayscale binding points located previous to the second current grayscale binding point; wherein the grayscale corresponding to the previous grayscale binding point and the respective grayscales corresponding to the at least two grayscale binding points are larger than the grayscale of the second current grayscale binding point;

obtaining a first relationship curve between grayscales and absolute values of gamma voltages by fitting the respective grayscales corresponding to the at least two grayscale binding points and the absolute values of the gamma voltages corresponding to the at least two grayscale binding points; and adjusting the gamma voltage corresponding to the second current grayscale binding point according to the grayscale corresponding to the second current grayscale binding point and the first relationship curve, in a way that the absolute value of the adjusted gamma voltage corresponding to the second current grayscale binding point is located on the first relationship curve; or the gamma adjustment method for the display penal, the method being applicable for adjusting the display panel after leaving factory, wherein the display panel comprises a non-transparent display area and a transparent display area, the transparent display area is a double-sided light-emitting display area, a front of the transparent display area is a side facing an ambient light and a back of the transparent display area is a side facing away from the ambient light, and the method comprises:

adjusting a data line input voltage of pixels in the transparent display area to a current gamma voltage corresponding to a current grayscale binding point;

obtaining a current back-side light-emitting luminance of the transparent display area;

obtaining a target back-side light-emitting luminance according to a grayscale corresponding to the current grayscale binding point and a pre-stored first correspondence between back-side light-emitting luminance of the transparent display area and grayscales; wherein for the current grayscale binding point, when the back-side light-emitting luminance of the transparent display area is the target back-side light-emitting luminance, a front-side light-emitting luminance of the transparent display area is substantially the same as a light-emitting luminance of the non-transparent display area;

determining a third target adjustment step according to a comparison result between the current back-side light-emitting luminance and the target back-side light-emitting luminance; and adjusting the data line input voltage of the pixels according to the third target adjustment step, and taking the data line input voltage when the back-side light-emitting luminance of the transparent display area is substantially the same as the target back-side light-emitting luminance as the target gamma voltage.

* * * * *